US007745374B2

(12) United States Patent
Tanaka et al.

(10) Patent No.: US 7,745,374 B2
(45) Date of Patent: Jun. 29, 2010

(54) THERMAL TRANSFER RECEIVING SHEET, PRODUCTION METHOD THEREOF AND IMAGE FORMING METHOD USING THE SHEET

(75) Inventors: Yoshimasa Tanaka, Tokyo (JP); Masato Kawamura, Yokohama (JP); Chikara Tsukada, Yokohama (JP); Kyoko Uchida, Tokyo (JP); Toshikazu Onishi, Yokohama (JP); Toru Nakai, Soka (JP); Kazuyuki Tachibana, Tokyo (JP); Hideaki Shinohara, Nishitokyo (JP)

(73) Assignee: Oji Paper Co., Ltd., Tokyo (JP)

( * ) Notice: Subject to any disclaimer, the term of this patent is extended or adjusted under 35 U.S.C. 154(b) by 440 days.

(21) Appl. No.: 10/566,202

(22) PCT Filed: Aug. 4, 2004

(86) PCT No.: PCT/JP2004/011512

§ 371 (c)(1),
(2), (4) Date: Jan. 27, 2006

(87) PCT Pub. No.: WO2005/011995

PCT Pub. Date: Feb. 10, 2005

(65) Prior Publication Data

US 2008/0063817 A1 Mar. 13, 2008

(30) Foreign Application Priority Data

Aug. 5, 2003 (JP) ..... 2003-287000
Apr. 15, 2004 (JP) ..... 2004-120094

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 4,778,782 A 10/1988 Ito et al. ..... 503/227

FOREIGN PATENT DOCUMENTS

| | | |
|---|---|---|
| EP | 0 300 505 | 1/1989 |
| JP | 61-197282 | 9/1986 |
| JP | 62-198497 | 9/1987 |
| JP | 63-87286 | 4/1988 |
| JP | 64-27996 | 1/1989 |

(Continued)

OTHER PUBLICATIONS

Japanese Office Action mailed Mar. 24, 2009.

*Primary Examiner*—Bruce H Hess
(74) *Attorney, Agent, or Firm*—Kratz, Quintos & Hanson, LLP

(57) ABSTRACT

A thermal transfer receiving sheet comprising a sheet-like support having sequentially formed on at least one surface thereof a hollow particle-containing intermediate layer and an image receiving layer, wherein the hollow particles have an average particle diameter of 0.2 to 35 μm and a hollow percentage by volume of 30 to 97% and the printing smoothness (Rp value) on the surface of the thermal transfer receiving sheet, as measured by using a Microtopograph under an applied pressure of 0.1 MPa 10 m-seconds after the initiation of pressure application, is 1.5 μm or less. A production method of the thermal transfer receiving sheet is also provided.

13 Claims, 1 Drawing Sheet

(a)

(b)

FOREIGN PATENT DOCUMENTS

| | | |
|---|---|---|
| JP | 4-275194 | 9/1992 |
| JP | 5-169845 | 7/1993 |
| JP | 6-143848 | 5/1994 |
| JP | 6-210968 | 8/1994 |
| JP | 6-227159 | 8/1994 |
| JP | 8-80685 | 3/1996 |
| JP | 9-99651 | 4/1997 |
| JP | 9-123623 | 5/1997 |
| JP | 11-291647 | 10/1999 |
| JP | 2000-272259 | 10/2000 |
| JP | 2001-39043 | 2/2001 |
| JP | 2001-138641 | 5/2001 |
| JP | 2001-199172 | 7/2001 |
| JP | 2002-103826 | 4/2002 |
| JP | 2002-166660 | 6/2002 |
| JP | 2002-200851 | 7/2002 |

THERMAL TRANSFER RECEIVING SHEET, PRODUCTION METHOD THEREOF AND IMAGE FORMING METHOD USING THE SHEET

TECHNICAL FIELD

The present invention relates to a thermal transfer receiving sheet for forming an image by superposing it on a thermal transfer sheet (ink ribbon) and thermally transferring the dye of the ink ribbon by means of a thermal head. More specifically, the present invention relates to a thermal transfer receiving sheet (hereinafter sometimes simply referred to as a "receiving sheet") being suitable particularly for a dye thermal transfer printer and having a hollow particle-containing intermediate layer between a sheet-like support and an image receiving layer, and also relates to a production method thereof and an image forming method using the thermal transfer receiving sheet.

BACKGROUND ART

A thermal printer has recently attracted attention, and a dye thermal transfer printer capable of printing a clear full color image has attracted particular attention. In a dye thermal transfer printer, a dye layer containing a dye of an ink ribbon is superposed on an image receiving layer (hereinafter sometimes simply referred to as a "receiving layer") containing a dye-dyeable resin of a receiving sheet, and the dye of the dye layer in a required portion is transferred at a predetermined concentration to the receiving layer by the effect of heat supplied from a thermal head or the like, whereby an image is formed. In the ink ribbon, three-color dye layer regions of yellow magenta and cyan or four-color dye layer regions of these three colors and black are sequentially provided. A full color image is obtained by repeatedly transferring respective color dyes, in sequence, to a receiving sheet. In the case of such a dye thermal transfer-system printer, the receiving sheet is generally fed in the flat sheet state.

With the progress of a digital image processing technique using a computer, the image quality or the like of an image recorded by the dye thermal transfer system is remarkably enhanced and the market for this system is expanded. Furthermore, the technique of controlling the temperature of a thermal head is improved and, along therewith, the demand for a high-speed high-sensitivity printing system is increasing. Therefore, how efficiently the heat value of a heating device such as thermal head is utilized for the image formation is an important problem to be solved. Also, low cost, simplified structure and the like of a printer are required, and this brings about a technical problem such as reduction in the printing pressure by a thermal head and prolongation of the head life. At present, a printer capable of printing one A6 size sheet within 30 seconds is available on the market, and it is expected that the demand for printing at a higher speed will increase in the future.

For efficiently forming a high-quality and high-density image, a receiving sheet comprising a support having provided thereon a receiving layer mainly comprising a dye-dyeable resin is generally used, but when a normal film is used as a substrate for the support, despite excellent smoothness, the heat from a thermal head escapes to the substrate to cause insufficient recording sensitivity or, as a film is lacking in the satisfactory cushioning property, close contact between the ink ribbon and the receiving sheet is unsatisfactory and, as a result, density unevenness or the like is generated.

In order to solve such problems, for example, a support obtained by laminating a foamed film with a core material layer such as paper sheets (see, for example, Japanese Unexamined Patent Publication (Kokai) No. 61-197282 (page 1)), and a support obtained by laminating a biaxially stretched film (synthetic paper) mainly comprising a thermoplastic resin such as polyolefin resin and containing a void structure, with a core material layer such as paper sheets (see, for example, Japanese Unexamined Patent Publication (Kokai) No. 62-198497 (page 1)) have been proposed as the support. The receiving sheet using such a support is excellent in the heat insulating property and smoothness but disadvantageously fails in having a paper-like texture or is expensive.

Furthermore, when a paper sheet is used as the support of the receiving sheet, similarly to the film, the recording sensitivity is insufficient and, although the cushioning property is somewhat higher than that of a film, the close contact between the ink ribbon and the receiving layer becomes non-uniform due to the uneven fiber density of the paper and the print tends to have irregular shading. Therefore, for the improvement of transfer density or the like, a receiving sheet where an intermediate layer containing hollow particles is provided between the paper support and the receiving layer has been disclosed (see, for example, Japanese Unexamined Patent Publication (Kokai) Nos. 63-87286 (pages 1 and 2) and 1-27996 (pages 1 to 3)). In this receiving sheet, the sensitivity is improved by the effect of enhancing the heat insulating property or cushioning property of the hollow particle-containing layer, but the hollow particles are liable to produce an irregularity on the receiving sheet surface.

With respect to the improvement of irregularity on the receiving sheet surface, a receiving sheet having, for example, a specific surface roughness or glossiness by specifying the average particle diameter or hollow percentage of a hollow particle used in the intermediate layer has been proposed (see, for example, Japanese Unexamined Patent Publication (Kokai) Nos. 9-99651 (pages 1 to 5) and 2001-39043 (pages 2 and 3)). Also, a receiving sheet comprising a substrate sheet having formed thereon a resin layer containing an air bubble layer and a receiving layer, where a smoothing treatment is applied to the air bubble layer and/or the receiving layer, has been proposed (see, for example, Japanese Unexamined Patent Publication (Kokai) No. 6-210968 (pages 2 to 4)).

However, a satisfactory correlation is not necessarily present between the surface roughness value of the receiving layer as measured by a conventional measuring method and the quality of an image actually obtained by a dye thermal transfer printer. Particularly, a good image quality can hardly be obtained in the printing by a current high-speed printer at a low printing pressure. Furthermore, when the hollow percentage by volume of the hollow particle is elevated, the receiving sheet surface is readily scratched. That is, there is a problem that generation of a scratch is liable to occur resulting from hitting with a nail, a pen point or the like against the sheet surface on handling the printed matter and the commercial value is seriously decreased.

Also, to improve the smoothness on the receiving sheet surface, a receiving sheet having a porous layer comprising a plurality of layers, where a laminate layer formed by co-extrusion of a thermoplastic resin is provided on the porous layer, has been proposed (see, for example, Japanese Unexamined Patent Publication (Kokai) No. 2000-272259 (page 2)). However, as a resin solution containing an air bubble formed by stirring or a thermally expansible resin of forming an excessive hollow is used for the porous layer on the core material layer side, sufficient smoothness can hardly be obtained or the formation of the laminate layer may cause, for example, deformation and collapse of the porous structure of the porous layer due to heat and the effect of enhancing the sensitivity and image quality is not necessarily at a satisfactory level. Furthermore, a receiving sheet having a receiving layer into which two or more kinds of fine hollow particles differing in particle diameter are incorporated has been proposed (see, for example, Japanese Unexamined Patent Publication (Kokai) No. 11-291647 (page 2)), but the hollow particles present in the receiving layer cannot satisfactorily provide the effect of enhancing the heat insulating property or cushioning property and adversely affect the dyeability or the like of the receiving layer and, as a result, the image tends to have insufficient uniformity.

In addition, the partition wall of the hollow particle used in such a receiving sheet having an intermediate layer is formed of a polymer material having a low glass transition temperature and, therefore, the hollow particle is generally poor in the heat resistance and may be thermally deform and collapse due to heat at the production of the receiving sheet or heat from a thermal head at the printing, making it difficult to control the printing density, or the printed area may be dented due to heat to impair the outer appearance. Accordingly, a sufficiently high image quality may be unobtainable in the printing by a current high-speed printer.

Also, a receiving sheet comprising a paper substrate having sequentially stacked thereon a hollow particle-containing layer and a dye receiving layer, where the cushion deformation percentage of the entire receiving sheet is from 10 to 30%, has been proposed (see, for example, Japanese Unexamined Patent Publication (Kokai) No. 2002-200851 (pages 2 to 5)). Although the construction material for the partition wall of the hollow particle is selected from the standpoint of enhancing the solvent resistance, as the heat resistance is not taken into account at all, a need for improvement still exists.

DISCLOSURE OF THE INVENTION

Under these circumstances, the present invention has been made and an object of the present invention is to solve the above-described problems of conventional receiving sheets by providing a thermal transfer receiving sheet being suitable particularly for a dye thermal transfer printer and having a hollow particle-containing intermediate layer, where the receiving sheet is assured of printing density equal to that of a synthetic paper or foamed film without using an expensive synthetic paper or foamed film and is improved in image defects such as irregular shading and white spots while realizing low cost, high sensitivity and high image quality. The object of the present invention includes providing the production method of the receiving sheet and an image forming method using the receiving sheet. In a preferred embodiment, the present invention provides the above-described thermal transfer receiving sheet, which has sufficiently high strength against compression and is free from occurrence of denting. In a more preferred embodiment, the present invention provides the above-described thermal transfer receiving sheet, which also has sufficiently high heat resistance.

The present invention includes the following inventions.

(1) A thermal transfer receiving sheet comprising a sheet-like support having sequentially formed on at least one surface thereof a hollow particle-containing intermediate layer and an image receiving layer, wherein the hollow particles have an average particle diameter of 0.2 to 35 μm and a hollow percentage by volume of 30 to 97% and the printing smoothness (Rp value) on the surface of the thermal transfer receiving sheet as measured by using Microtopograph, under an applied pressure of 0.1 MPa 10 milli-seconds after the initiation of pressure application, is 1.5 μm or less.

(2) The thermal transfer receiving sheet according to (1), wherein the thickness of the intermediate layer is from 20 to 90 μm.

(3) The thermal transfer receiving sheet according to (1) or (2), wherein the ratio by mass of all hollow particles to the entire solid content mass of the intermediate layer is from 30 to 75% by mass.

(4) The thermal transfer receiving sheet according to any one of (1) to (3), which has a barrier layer stacked between the intermediate layer and the image receiving layer.

(5) The thermal transfer receiving sheet according to any one of (1) to (4), wherein the sheet-like support is a sheet-like support mainly comprising a cellulose pulp.

(6) The thermal transfer receiving sheet according to any one of (1) to (5), wherein a back surface layer containing at least a polymer resin and an organic and/or inorganic fine particles is provided on the side of the sheet-like support in which the image receiving layer is not provided.

(7) The thermal transfer receiving sheet according to any one of (1) to (6), wherein the compressive modulus of elasticity, based on JIS K 7220, of the thermal transfer receiving sheet is 30 MPa or less.

(8) The thermal transfer receiving sheet according to any one of (1) to (7), wherein the intermediate layer comprises two kinds of hollow particles A and B differing in the average particle diameter and the average particle diameters $L_A$ (μm) and $L_B$ (μm) of respective hollow particles satisfy all of the following relational formulae (1) to (3):

$$L_A = 2 \text{ to } 35\ \mu\text{m} \quad (1)$$

$$L_B = 0.2 \text{ to } 9\ \mu\text{m} \quad (2)$$

$$0.05 \leqq L_B/L_A \leqq 0.4 \quad (3)$$

(9) The thermal transfer receiving sheet according to any one of (1) to (8), wherein the intermediate layer comprises, as the hollow particles, hollow particles with the partition wall being formed of a polymer material having a glass transition temperature of 130° C. or more.

(10) The thermal transfer receiving sheet according to (9), wherein the polymer material of the hollow particles with the partition wall being formed of a polymer material having a glass transition temperature of 130° C. or more, is obtained from a component mainly comprising a nitrile-based monomer.

(11) The thermal transfer receiving sheet according to (10), wherein the nitrile-based monomer is at least one member selected from the group consisting of acrylonitrile, methacrylonitrile, α-chloroacrylonitrile, α-ethoxyacrylonitrile and fumaronitrile.

(12) An image forming method using the thermal transfer receiving sheet according to any one of (1) to (11), comprising the steps of applying a pressure treatment of 1.0 MPa or more to the thermal transfer receiving sheet surface during and/or after printing by a dye thermal transfer printer.

(13) A method for producing a thermal transfer receiving sheet comprising a sheet-like support having sequentially formed on at least one surface thereof a hollow particle-containing intermediate layer and an image receiving layer, the method comprising the steps of, after providing the intermediate layer by coating an intermediate layer coating solution comprising hollow particles having an average particle diameter of 0.2 to 35 μm and a hollow percentage by volume of 30 to 97% on at least one surface of the sheet-like support and drying it and/or after providing the image receiving layer on the intermediate layer, applying a smoothing treatment step of passing the sheet through a nip part having a pair of rolls consisting of a heating roll and a press roll so that the printing smoothness (Rp value) on the surface of the thermal transfer receiving sheet as measured, by using Microtopograph, under an applied pressure of 0.1 MPa 10 milli-seconds after the initiation of pressure application, can be 1.5 μm or less.

(14) The method for producing a thermal transfer receiving sheet, according to (13), which further comprises a thickness restoring treatment step of, after the smoothing treatment step, subsequently heating the thermal transfer receiving sheet by contacting the sheet surface with a heating roll in a pressure-released state.

The receiving sheet of the present invention is a receiving sheet with very excellent quality suitable for a dye thermal transfer printer, having a hollow particle-containing intermediate layer and ensuring that irregular shading, white spots or the like is improved and high-sensitivity recording with high image quality can be performed at a low cost. Furthermore, according to the image processing method of the present invention, generation of a scratch, a bruise or the like on the print surface can be reduced. In a preferred embodiment, the receiving sheet of the present invention has sufficiently high strength against compression and is free from the occurrence of denting. In a more preferred embodiment, the receiving sheet of the present invention also has a sufficiently high heat resistance.

BEST MODE FOR CARRYING OUT THE INVENTION

Figure 1:
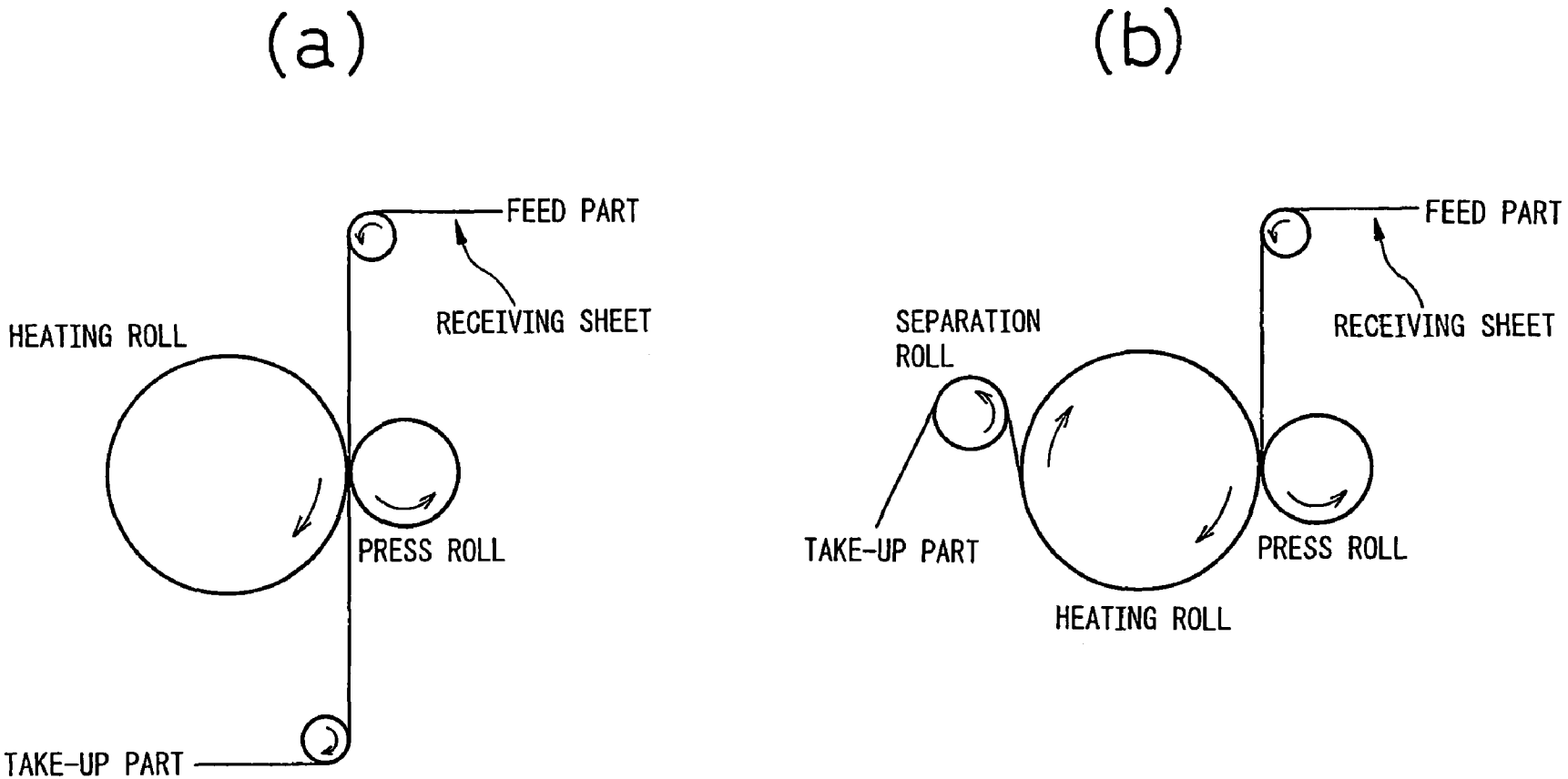
FIG. 1 is a schematic view showing a step of (a) a smoothing treatment for the receiving sheet of the present invention or (b) a smoothing treatment+thickness restoring treatment.

The present invention is described in detail below by referring to preferred embodiments.

In order to obtain a high-sensitivity high-quality image, the receiving sheet must be sufficiently put into close contact with the ink ribbon at printing and be deformed by following the shape of a thermal head so that the heat from the thermal head can be efficiently used for the image formation. Accordingly, the receiving sheet is required to exhibit high smoothness on the receiving sheet surface, under an applied pressure, at printing.

In the present invention, as a result of intensive investigations, it has been found that when the printing smoothness (Rp value) on the receiving sheet surface (receiving layer surface), as measured by using Microtopograph under an applied pressure of 0.1 MPa 10 milli-seconds after the initiation of pressure application, is set to 1.5 μm or less, a high-sensitivity and high-quality image can be obtained. The Rp value is substantially from 0 to 1.5 μm, preferably from 0 to 1.0 μm. If the Rp value exceeds 1.5 μm, the receiving sheet may be deteriorated in the printing density and printing image quality due to insufficient smoothness on the receiving sheet surface.

Incidentally, the printing smoothness (Rp value) as used in the present invention is determined by measuring a physical quantity proportional to the average depth of dents on the surface of a sample contact-bonded to a standard plane (prism). The principle of measurement is disclosed, for example, in Nippon Insatsu Gakkai Ronbun-Shu (Japan Printing Society Articles), Vol. 17, No. 3 (1978), and Nippon Insatsu Gakkai Dai 60-Kai Shuki Kenkyu Happyo Kai (60th Spring Meeting for Reading Research Papers of Japan Printing Society) (1978). On the other hand, in the paper-making industry, an apparatus of calculating a smoothness from an air leakage amount, such as Bekk smoothness meter, Oken-type smoothness meter and Smoother smoothness meter, is used in many cases to show the smoothness of paper. However, considering the printing by a printer, it has been found that a printing smoothness (Rp value) under specific conditions can successfully reproduce the contact state of the receiving sheet to a thermal head through an ink ribbon at actual printing.

At the time of a sublimating dye being transferred from an ink ribbon to a receiving layer of a receiving sheet to form an image, the pressure applied to the receiving sheet due to the pressing pressure between the thermal head and the platen roll of a printer is usually on the order of 0.1 to 0.5 MPa, and the application time of a heat energy from the thermal head is generally 10 milli-seconds or less. In this way, the smoothness of the receiving sheet under an applied pressure in a very short time, that is, the contact ratio between the receiving sheet and the thermal head, is important.

As for the apparatus of measuring an optical contact ratio of a glass surface with paper under an applied pressure, a specular reflection smoothness meter (also called a "Chapman smoothness meter") has been conventionally known. This specular reflection smoothness meter can reproduce an applied pressure at the thermal transfer printing, but reading of the measured contact ratio takes at earliest several seconds from the initiation of pressure application and this is a very long time as compared with the application time of a heat energy at the actual thermal transfer printing. Thus, the actual printing state can hardly be reproduced.

On the other hand, the printing smoothness (Rp value) can be calculated by measuring the optical contact ratio of the prism surface with paper at earliest in 10 milli-seconds after the initiation of pressure application and as a result of studies on the relationship between the Rp value calculated from this contact ratio and the printing image quality, it has been found that the Rp value, measured 10 milli-seconds after the initiation of applying a pressure of 0.1 MPa to the prism of a receiving sheet, has a close correlation with the printing image quality. As for the measuring apparatus, for example, a printing smoothness tester (Optical Contact Ratio Measuring Apparatus Microtopograph, manufactured by Toyo Seiki Seisaku-Sho, Ltd.) can be used.

Also, the compressive modulus of elasticity as measured according to JIS K 7220 of the receiving sheet of the present invention is preferably 30 MPa or less, more preferably from 3 to 20 MPa, still more preferably from 4 to 16 MPa. If the compressive modulus of elasticity of the receiving sheet exceeds 30 MPa, the image quality may be worsened, or ribbon wrinkling may be generated on the printed surface to reduce the commercial value.

The receiving sheet of the present invention has a sufficiently low compressive modulus of elasticity and therefore, when the receiving sheet is interposed between a thermal head and a platen roller through an ink ribbon at the printing, the inside of the receiving sheet is appropriately deformed to enhance the close contact of the receiving sheet with the thermal head, so that excellent recording density and high image quality can be obtained.

The ink ribbon locally undergoes thermal shrinkage due to heat of the thermal head and this causes generation of wrinkles but, as the compressive modulus of elasticity of the receiving sheet is sufficiently low, the receiving sheet may deform by following the wrinkle shape, and thus prevents transfer of the wrinkle shape generated on the ink ribbon to the printed surface, whereby shows a good appearance. However, if the compressive modulus of elasticity is high, the receiving sheet cannot be satisfactorily deformed, fails to follow the wrinkle shape and, therefore, the wrinkle shape generated on the ink ribbon is transferred to the printed surface, giving rise to a defective appearance.

As for the layer constitution, the receiving sheet of the present invention comprises at least a sheet-like support, an intermediate layer and a receiving layer. Also, the receiving sheet of the present invention is preferably constituted such that an intermediate layer containing two kinds of hollow particles A and B differing in the average particle diameter from each other and a receiving layer are sequentially formed on a sheet-like support. Of course, other layers may be further provided as an intermediate layer to take a multilayer structure of two or more layers. These layers are described in detail below.

(Sheet-Like Support)

Examples of the sheet-like support which is appropriately used in the present invention include (1) paper sheets mainly comprising a cellulose pulp, such as wood-free paper, e.g., acidic paper, neutral paper, medium quality paper, coated paper, art paper, glassine paper, cast-coated paper, laminate paper having provided on at least one surface thereof a thermoplastic resin layer, e.g., polyolefin resin, synthetic resin-impregnated paper, emulsion-impregnated paper, synthetic rubber latex-impregnated paper, synthetic resin internally-added paper, thermal expansible particle-containing foamed paper or paper board, or (2) films including plastic films mainly comprising a thermoplastic resin such as polyolefin, e.g., polyethylene, polypropylene, polyester, e.g., polyethylene terephthalate, polyamide, polyvinyl chloride or polystyrene, a porous stretched film having a single-layer or multilayer structure obtained by extruding a melt mixture comprising a blend of the above-described resin with an incompatible resin or an inorganic pigment from an extruder and stretching the extruded product to generate voids, e.g., synthetic paper, porous polyester film, or a composite film obtained by stacking and laminating these films with each other or such a film with another film or paper.

Among these sheet-like supports, paper sheets mainly comprising a cellulose pulp are preferred because of their low heat shrinkability, high heat insulating property, good texture as a receiving paper, and low cost.

The sheet-like support for use in the present invention may have a constitution that a first substrate layer on which the receiving layer is formed, a pressure-sensitive adhesive layer, a release agent layer and a second substrate layer, are sequentially stacked. Alternatively, a sheet-like support having a so-called sticker or seal-type structure may, of course, be used.

The sheet-like support for use in the present invention preferably has a thickness of 100 to 300 μm. If the thickness is less than 100 μm, insufficient mechanical strength may result and the receiving sheet obtained therefrom comes to have low rigidity and exhibit unsatisfactory repulsion to deformation, as a result, curling of the receiving sheet may not be sufficiently prevented from occurrence at the printing. If the thickness exceeds 300 μm, the obtained receiving sheet comes to have an excessively large thickness and the number of receiving sheets housed in a printer may decrease or in the case of housing a predetermined number of receiving sheets, this requires increase in the printer capacity and there may arise a problem such as difficulty in downsizing a printer.

(Intermediate Layer)

In the present invention, an intermediate layer is formed on at least one surface of the sheet-like support. The intermediate layer mainly comprises a binder resin and a hollow particle and has a porous structure to yield a high cushioning property, so that even when paper is used as the sheet-like support, a high-sensitivity receiving sheet can be obtained. By incorporating a hollow particle into the intermediate layer, an appropriate freedom degree of deformation is given to the receiving sheet, and the followability, and close contact of the receiving sheet with the printer head shape and ink ribbon shape, are improved, so that the thermal efficiency of a printer head for the receiving layer can be enhanced even in a low energy state and the printing density and image quality can be elevated. Furthermore, a printing failure ascribable to ribbon wrinkling generated on an ink ribbon at an operation of applying a high energy in a high-speed printer can be also prevented at the same time.

By incorporating hollow particles into the intermediate layer, the heat insulating property of the receiving sheet and in turn the thermal efficiency of a thermal head for the receiving layer are enhanced and therefore, the printing density and image quality are elevated. Also, even when a high pressure due to the thermal head or transporting roll of a printer is imposed on the receiving sheet, this stress can be absorbed in the inside of the receiving sheet and, therefore, the resistance of the receiving sheet against formation of a spike mark or a dent on the printed surface by a transporting roll is improved.

The hollow particle used in the intermediate layer of the present invention comprises a shell formed of a polymer material and one or more hollow part surrounded by the shell. The production method of the hollow particle is not particularly limited, but the hollow particle may be selected from the hollow particles (i) and (ii) produced as follows:

(i) a foamed hollow particle produced by thermally expanding a thermoplastic polymer material containing a thermally expansible substance (hereinafter sometimes referred to an "prefoamed hollow particle"); and (ii) a microcapsule-like hollow particle obtained by volatilizing and dissipating a pore-forming material from a microcapsule which is produced by a microcapsule polymerization method using a polymer-forming material as the shell-forming material and using a volatile liquid as the pore-forming material.

As for the production of the hollow particle, it may be also considered to use a particle comprising a thermoplastic substance containing a thermally expansible substance (hereinafter sometimes referred to as a "foaming particle") in the non-foamed state and foaming the particle by the effect of heat in the heating step such as drying step during the production of the receiving sheet, thereby forming a foamed hollow particle. However, when a thermoplastic substance containing a thermally expansible substance is foamed by heating in the production process of the receiving sheet, foaming to give a uniform particle diameter is difficult and the particle diameter after thermal expansion cannot be strictly controlled, as a result, the intermediate layer surface may have a large irregularity to give poor smoothness. In the receiving sheet having such an intermediate layer, the receiving layer surface also comes to have a large irregularity and the thermally transferred image may be decreased in the uniformity, giving rise to poor image quality. Accordingly, in the present invention, a prefoamed hollow particle produced by thermally expanding in advance a particle comprising a thermoplastic substance containing a thermally expansible substance is preferably used.

The prefoamed hollow particle produced by thermally expanding a thermally expansible substance-containing thermoplastic substance is obtained, for example, as follows. A particle produced by enclosing a volatile low boiling point hydrocarbon (e.g., n-butane, i-butane, pentane and/or neopentane) as the thermally expansible core substance in a thermoplastic material and using a homopolymer or copolymer of vinylidene chloride, vinyl chloride, acrylonitrile, methacrylonitrile, styrene, (meth)acrylic acid ester or the like as the thermoplastic material working out to the capsule shell (wall) material is previously subjected to a treatment such as heating and thereby thermally expanded to a predetermined particle size to form a prefoamed hollow particle.

The prefoamed hollow particle produced as above by thermally expanding a thermally expansible substance-containing thermoplastic substance generally has a low specific gravity and therefore, for the purpose of more enhancing the handleability and dispersibility, an inorganic powder such as calcium carbonate, talc and titanium dioxide may be attached by heat fusion to the surface of this foamed hollow particle. The foamed composite hollow particle with the surface being coated by an inorganic powder, obtained in this way, can also be used in the present invention.

In the microcapsule-like hollow particle for use in the present invention, the hollow core part is formed by drying a microcapsule having a shell formed of a polymer material such as styrene-acryl-based copolymer or hard resin (e.g., melamine resin) and containing a volatile liquid such as water in the core part, thereby volatilizing and dissipating the water. This microcapsule can be obtained from a polymer-forming material (shell-forming material) and a volatile liquid (pore-forming material) by a microcapsule-forming polymerization method.

The hollow particle for use in the present invention has an average particle diameter of 0.2 to 35 μm, preferably from 0.5 to 10 μm, more preferably from 0.8 to 8 μm. If the average particle diameter of the hollow particle is less than 0.2 μm, the obtained hollow particle comes to have a low hollow percentage by volume and this may lead to low heat insulating property or cushioning property in general and in turn to an incapability of obtaining a sufficiently high effect of enhancing the sensitivity and image quality. If the average particle diameter exceeds 35 μm, the obtained intermediate layer may be reduced in the surface smoothness and the irregularity on the receiving sheet surface may be increased, giving rise to insufficient uniformity and poor image quality of the thermally transferred image.

Also, the hollow particle for use in the present invention preferably has a maximum particle diameter of 25 μm or less, more preferably 20 μm or less. If the maximum particle diameter of the hollow particle exceeds 25 μm, uneven print shading or white spot ascribable to a coarse particle may be generated in the thermally transferred image to deteriorate the image quality. In order to cause the hollow particle to be free of a coarse particle having a maximum particle diameter exceeding 25 μm, this may be attained by adjusting the setting of the average particle diameter in the production of the hollow particle which generally exhibits a normal distribution state. Also, a hollow particle free of a coarse particle can be obtained without fail by providing a step of classifying the particles.

Incidentally, the particle diameter of the hollow particle as used in the present invention can be measured by using a general particle diameter measuring apparatus, and the particle diameter is a value measured by using a laser diffraction-type particle size distribution analyzer (SALD2000, trade name, manufactured by Shimadzu Corporation).

The hollow particle for use in the present invention has a hollow percentage by volume of 30 to 97%, preferably from 75 to 95%. If the hollow percentage by volume is less than 30%, the image quality may be deteriorated, whereas if the hollow percentage by volume exceeds 97%, the coating layer comes to have poor strength and the hollow particle may be collapsed during coating or drying to incur a reduction in the surface smoothness.

In the measurement of the hollow percentage by volume of the hollow particles, a direct-reading chemical balance (sensibility: 1 mg), a measuring flask (100-ml volume) and a sieve (12 mesh) as the measuring instruments and an isopropyl alcohol (IPA) as the reagent are used, and the sample for measurement is a hollow particle previously dried at 45° C. for 48 hours. The true specific gravity is measured by the following procedure:

(1) the weight of the measuring flask is precisely measured (W1), (2) about 0.5 g of the sample is charged into the measuring flask and the weight is precisely measured (W2: measuring flask+sample), (3) IPA is added up to the marked line and the weight is precisely measured (W3: measuring flask+sample+IPA), and (4) IPA as the control is added to the measuring flask up to the marked line and the weight is precisely measured (W4).

The true specific gravity and hollow percentage are calculated according to the following formulae:

$$\text{True specific gravity}=A/B$$

provided that $$A=(W2-W1)\times\{(W4-W1)/100\} \text{ and}$$

$$B=\{(W4-W1)-(W3-W2)\}.$$

$$\text{Hollow percentage (\%)}=\{1-1/(\text{specific gravity of film material/true specific gravity})\}\times 100$$

The blending amount of the hollow particles in the intermediate layer is, in terms of the ratio of the hollow particle mass to the total solid content mass of the entire intermediate layer, preferably from 30 to 75%, more preferably from 35 to 70%. If the ratio of the hollow particle mass to the total solid content mass of the entire intermediate layer is less than 30%, the heat insulating property or cushioning property of the intermediate layer becomes insufficient and the effect of enhancing the sensitivity and image quality may not be satisfactorily obtained, whereas if the ratio by mass of the hollow particle exceeds 75%, the obtained coating solution for the intermediate layer may be reduced in coatability to fail to provide a sufficiently high coating strength and a desired effect may not be obtained.

In the case where the intermediate layer contains two kinds of hollow particles A and B differing in the above-described average particle diameter, hollow particles having a certain small particle diameter are filled between hollow particles having a certain large particle diameter to effect reinforcement and the compression resistance of the intermediate layer is strengthened. As a result, the receiving sheet as a whole has a hardly any collapsible structure. Furthermore, by virtue of this structure, the irregularity on the intermediate layer surface is decreased, and the surface uniformity and in turn the image quality of the print are enhanced.

Accordingly, even when the receiving sheet receives a high pressure from a thermal head, a transporting roll or the like of a printer, the receiving sheet having enhanced compression resistance is restored immediately after the stress is absorbed inside the receiving sheet and eliminated, so that generation of a spike mark, a dent or the like on the printed surface of the receiving sheet can be prevented.

The average particle diameter $L_A$ of the hollow particle A contained in the intermediate layer of the present invention is preferably from 2 to 35 μm, more preferably from 3 to 30 μm, still more preferably from 3 to 25 μm. If the average particle diameter $L_A$ is less than 2 μm, the volume in the hollow portion is insufficient due to the small particle size of the hollow particle A, giving rise to an unsatisfactory heat insulating property or cushioning property, and a sufficiently high effect of enhancing the sensitivity and image quality can hardly be obtained. On the other hand, if the average particle diameter $L_A$ exceeds 35 μm, the strength of the intermediate layer is decreased and a dent is readily generated on the receiving sheet during printing by a thermal head. Also, the irregularity on the intermediate layer surface may be increased, and the uniformity, image quality or the like of the image tends to be deteriorated.

The average particle diameter $L_B$ of the hollow particle B is preferably from 0.2 to 9 μm, more preferably from 0.3 to 8 μm, still more preferably from 0.4 to 7 μm. If the average particle diameter $L_B$ is less than 0.2 μm, the hollow particle B can hardly fill the gap between hollow particles A due to its excessively small average particle diameter, whereas if the average particle diameter $L_B$ exceeds 9 μm, intrusion into the gap between hollow particles A becomes difficult. In either case, the effect of enhancing the compression resistance may not be satisfactorily obtained.

The average particle diameter ratio ($L_B/L_A$) of the hollow particle A and the hollow particle B contained in the intermediate layer of the present invention is preferably $0.05 \leqq L_B/L_A \leqq 0.4$, more preferably $0.1 \leqq L_B/L_A \leqq 0.4$, still more preferably $0.15 \leqq L_B/L_A \leqq 0.3$. If $L_B/L_A > 0.4$, the hollow particle B cannot intrude into the gap of hollow particles A because of the excessively large average particle diameter of the hollow particle B and when intruded, the gap may be expanded, as a result, the compression resistance of the receiving sheet becomes insufficient. Also, the smoothness on the intermediate layer surface is reduced and in turn, the obtained receiving sheet may be decreased in image quality or sensitivity. On the other hand, if $L_B/L_A < 0.05$, the hollow particle B cannot fill the gap between particles due to its excessively small average particle diameter and the effect of enhancing the compression resistance of the receiving sheet may not be satisfactorily obtained.

The coefficient of variation in each particle diameter of the hollow particle A and the hollow particle B is preferably 35% or less, more preferably 30% or less, still more preferably 25% or less. The coefficient of variation in the particle diameter as used herein is a percentage of a value obtained by dividing the standard deviation of the particle diameter by the average particle diameter.

Incidentally, the average particle diameters of the hollow particles A and B and the standard deviation of the particle diameter can be measured by using a general particle diameter measuring apparatus and may be measured by using, for example, a laser diffraction-type particle size distribution analyzer (SALD2000, trade name, manufactured by Shimadzu Corporation).

If the coefficient of variation in the particle diameter of the hollow particle A exceeds 35%, the hollow percentage decreases due to increase in the number of hollow particles A having a particle diameter in the lower limit region, giving rise to unsatisfied heat insulating property or cushioning property, and a sufficiently high sensitivity or image quality may not be obtained. Alternatively, due to increase in the number of hollow particles A having a particle diameter in the upper limit region, the strength of the intermediate layer becomes insufficient to readily cause generation of a dent on the receiving sheet at the printing, or the irregularity on the intermediate layer surface may be increased to deteriorate the uniformity, image quality or the like of the image.

If the coefficient of variation in the particle diameter of the hollow particle B exceeds 35%, a hollow particle B having a particle diameter in the lower limit region cannot satisfactorily fill the gap between hollow particles A, or a hollow particle B having a particle diameter in the upper limit region cannot intrude into the gap between hollow particles A and because of this or other reasons, the compression resistance of the receiving sheet sometimes becomes insufficient.

The hollow percentage by volume of the hollow particle A is preferably from 60 to 97%, more preferably from 65 to 95%. If the hollow percentage by volume is less than 60%, a good balance between the compression resistance of the intermediate layer and the enhancement of the sensitivity and image quality may not be obtained, whereas if the hollow percentage by volume exceeds 97%, the coating material may have poor stability or the obtained intermediate layer may suffer from insufficient coating strength.

The hollow percentage by volume of the hollow particle B is preferably from 30 to 97%, more preferably from 35 to 95%. If the hollow percentage by volume of the hollow particle is less than 30%, the sensitivity and image quality may decrease, whereas if the hollow percentage by volume exceeds 97%, the coating material may be reduced in the stability.

Incidentally, the hollow percentage by volume of the hollow particle A or B indicates a ratio of the volume in the hollow portion to the particle volume. Specifically, the hollow percentage by volume can be obtained from the specific gravity of a hollow particle liquid dispersion comprising a hollow particle and a poor solvent, the partial ratio by mass of the hollow particle in the liquid dispersion, the true specific gravity of the polymer resin constituting the shell (wall) of the hollow particle, and the specific gravity of the poor solvent. The poor solvent is a solvent not dissolving and/or swelling the resin constituting the wall of the hollow particle, and examples thereof include water and isopropyl alcohol. The hollow percentage by volume of the hollow particle may also be determined from a photograph of the cross-section of the intermediate layer by using, for example, a small angle X-ray scattering measuring apparatus (RU-200, trade name, produced by Rigaku Corporation).

The blending ratio of two kinds of hollow particles A and B differing in the average particle diameter contained in the intermediate layer varies depending on the degree of filling density of hollow particle, the apparent density and average particle diameter of hollow particle, and the like, but assuming that the masses of the hollow particles A and B contained in the intermediate layer are $W_A$ and $W_B$, respectively, the ratio of masses ($W_B/W_A$) is preferably from 0.001 to 1, more preferably from 0.003 to 0.8.

The intermediate layer of the present invention contains at least a predetermined amount of hollow particles with the partition wall being formed of a polymer material preferably having a glass transition temperature (Tg) of 130° C. or more, more preferably 140° C. or more, still more preferably from 150 to 200° C. (hereinafter, this hollow particle is sometimes simply referred to as a "hollow particle having a Tg of 130° C. or more.") Since this intermediate layer has a porous structure, the receiving sheet is enhanced in the heat insulating property, as a result, the printing density is increased and the image quality is improved. The formation of the intermediate layer imparts an appropriate freedom degree of deformation to the receiving sheet and brings about enhancement of shape followability and close contact of the receiving sheet to a printer head or an ink ribbon, so that the thermal efficiency of a printer head for the receiving layer can be enhanced even in a low energy state and the printing density and image quality of the printed image can be elevated. Furthermore, a printing failure ascribable to ribbon wrinkling generated on an ink ribbon at an operation of applying a high energy in a high-speed printer can be also prevented at the same time.

If the glass transition temperature (Tg) is less than 130° C., the heat resistance of the hollow particle is low and the deformation and collapse of the hollow particle may occur due to heat in the drying step during production. Furthermore, the image after printing is dented due to heat to give a poor appearance and this is not preferred. On the other hand, if the glass transition temperature (Tg) is too high, an excessively large quantity of heat may be necessary for bringing about foaming in the production process of foaming a non-foamed hollow particle and this is economically disadvantageous.

Incidentally, the Tg of the hollow particle is a value measured according to the method specified in JIS K 7121 by using a differential scanning calorimeter (SSC5200, trade name, manufactured by Seiko Electronic Industry).

The polymerizable monomer used in the production of the hollow particle having a Tg of 130° C. or more mainly comprises a nitrile-based monomer and for the purpose of improving thermal expansibility, heat resistance, solvent resistance or the like, for example, a non-nitrile-based monomer and a crosslinking monomer are appropriately used, if desired.

Examples of the nitrile-based monomer include acrylonitrile, methacrylonitrile, α-chloroacrylonitrile, α-ethoxyacrylonitrile, fumaronitrile and an arbitrary mixture thereof. Among these, acrylonitrile and/or methacrylonitrile are preferred. A homopolymer of acrylonitrile or methacrylonitrile has a high glass transition temperature (Tg) and is excellent in the heat resistance, chemical resistance and gas barrier property and therefore, use of acrylonitrile or methacrylonitrile is particularly preferred in the present invention.

Examples of the non-nitrile-based monomer include an acrylic acid ester, a methacrylic acid ester, styrene, vinyl acetate, vinyl chloride, vinylidene chloride, butadiene, vinylpyridine, α-methylstyrene, chloroprene, neoprene and an arbitrary mixture thereof. Among these, methyl acrylate, methyl methacrylate and ethyl methacrylate are preferred. The non-nitrile-based monomer is preferably used in an amount of 25 parts by mass or less per 100 parts by mass of the nitrile-based monomer. If the amount of the non-nitrile-based monomer used exceeds 25 parts by mass, the glass transition temperature of the obtained hollow particle may decrease to cause reduction in the heat resistance or lack of gas barrier property, and the desired quality may not obtained.

As for the crosslinking monomer having two or more polymerizable double bonds within the monomer molecule, a polyfunctional vinyl monomer and/or a monomer having an internal olefin are preferred. Specific examples thereof include divinylbenzene, ethylene glycol dimethacrylate, triethylene glycol dimethacrylate, triacrylformal, trimethylolpropane trimethacrylate, allyl methacrylate, 1,3-butyl glycol dimethacrylate and triallylisocyanate. Among these, a trifunctional crosslinking monomer such as triacrylformal and trimethylolpropane trimethacrylate are preferred. The crosslinking monomer is preferably used in an amount of 3 parts by mass per 100 parts by mass of the nitrile-based monomer. If the amount of the crosslinking monomer used exceeds 3 parts by mass, the crosslinking degree becomes excessively large and poor expansibility may result.

The wall material for the hollow particle having a Tg of 130° C. or more is prepared, if desired, by further blending an appropriate polymerization initiator to the above-described components. Examples of the polymerization initiator include azobisisobutyronitrile and benzoyl peroxide.

Examples of the low boiling point organic solvent used in the production of the hollow particle having a Tg of 130° C. or more include a low molecular weight hydrocarbon such as ethane, ethylene, propane, propene, butane, isobutane, butene, isobutene, pentane, neopentane, isopentane, hexane and heptane; a chlorofluorocarbon such as $CCl_3F$, $CCl_2F_2$ and $CClF_3$; and a silane compound such as tetramethylsilane and trimethylethylsilane. Among these, preferred is a low molecular weight hydrocarbon having a boiling point of −20 to 50° C., such as butene, isobutane, isobutene, pentane, isopentane and neopentane. One of these low boiling point organic solvents may be used alone or two or more thereof may be used in combination.

The method of microencapsulating a thermally expansible substance by using the above-described polymerizable material is not particularly limited, and a conventional method may be used. The method described, for example, in Japanese Examined Patent Publication (Kokoku) No. 42-26524 is particularly preferred, where a polymerizable monomer is mixed with a thermally expansible substance and a polymerization initiator and the obtained mixture is suspension-polymerized in an aqueous medium containing an appropriate emulsification dispersant and the like.

The non-foamed particle containing, in the inside thereof, a low boiling point organic solvent as a thermally expansible substance, which is obtained by the suspension-polymerization, is then externally heated at a temperature higher than the boiling point of the low boiling point organic solvent, whereby the thermally expansible substance is thermally expanded to give a predetermined particle diameter, and a hollow particle in a prefoamed state is obtained. This hollow particle is repeatedly subjected to filtration and water washing by using a centrifugal separator, and the resulting cake-like substance is dried to obtain the prefoamed hollow particles of the present invention.

The prefoamed hollow particle having a Tg of 130° C. or more preferably has an average particle diameter of 2 to 10 μm, more preferably from 2.5 to 9 μm, still more preferably from 3 to 8 μm.

If the average particle diameter of the prefoamed hollow particle having a Tg of 130° C. or more is less than 2 μm, the volume in the hollow portion of the hollow particle is small due to the small average particle diameter and the heat insulating property or cushioning property is generally poor, as a result, a sufficiently high effect of enhancing the sensitivity and image quality may not be obtained.

If the average particle diameter exceeds 10 μm, the irregularity on the surface of the obtained intermediate layer becomes excessively large and the image may suffer from insufficient uniformity and poor image quality.

The hollow particle having a Tg of 130° C. or more preferably has a hollow percentage by volume of 60 to 90%, more preferably from 65 to 85%.

If the hollow percentage by volume is less than 60%, the obtained receiving sheet may be disadvantageously inferior in the sensitivity and image quality, whereas if the hollow percentage by volume exceeds 90%, the stability of the coating material or the coating strength of the obtained intermediate layer may be deteriorated and this is not preferred.

In the intermediate layer, other hollow particles may be used in combination within the range of not impairing the effect of the hollow particle having a Tg of 130° C. or more.

As for the other hollow particles used in combination, the average particle diameter is preferably on the order of 0.3 to 10 μm and the hollow percentage by volume is preferably on the order of 30 to 90%, though these may vary depending on the purpose and cannot be unequivocally specified.

The ratio by mass of the hollow particle having a Tg of 130° C. or more to the total mass of the hollow particle of the present invention contained in the intermediate layer and the other hollow particles used in combination is preferably at least about 70% by mass. If the ratio by mass of the hollow particles having a Tg of 130° C. or more contained in the intermediate layer is less than about 70% by mass, the intermediate layer comes to have insufficient heat resistance and the dent on the receiving sheet by printing becomes large, as a result, the effect of enhancing the image quality may not be satisfactorily obtained.

Furthermore, for the purpose of enhancing the coatability or smoothness or improving the collapse of the intermediate layer or for other purposes, hollow particles having a different average particle diameter may also be used in combination.

In order to cause the intermediate layer to exert the desired performance such as heat insulating property and cushioning property, the film thickness of the intermediate layer is preferably from 20 to 90 μm, more preferably from 25 to 85 μm. If the film thickness of the intermediate layer is less than 20 μm, insufficient heat insulating property or cushioning property results and the effect of enhancing the sensitivity and image quality may be unsatisfied, whereas if the film thickness exceeds 90 μm, the heat insulating or cushioning effect is saturated and this may be disadvantageous not only in that the performance cannot be elevated any more but also in view of profitability.

The intermediate layer of the present invention comprises hollow particles and an adhesive resin. Considering the solvent resistance of the hollow particles, the coating material for the intermediate layer of the present invention is preferably an aqueous coating material. Accordingly, the adhesive resin is preferably an aqueous resin, though both an aqueous resin and an organic solvent-soluble resin are usable. The adhesive resin used is not particularly limited and for example, a hydrophilic polymer resin such as polyvinyl alcohol-based resin, cellulose-based resin or its derivative, casein and starch derivative, is preferably used in view of film-forming property, heat resistance and flexibility. Also, an emulsion of various resins such as (meth)acrylic acid ester resin, styrene-butadiene copolymer resin, urethane resin, polyester resin and ethylene-vinyl acetate copolymer resin, is used as an aqueous resin with low viscosity and high solid content. Considering the coating strength, adhesive property and coatability of the intermediate layer, a hydrophilic polymer resin and an emulsion of various resins described above are preferably used in combination as the adhesive resin for use in the intermediate layer.

The intermediate layer may contain various additives, if desired. For example, one species appropriately selected from an antistatic agent, an inorganic pigment, an organic pigment, a crosslinking agent for resin, a defoaming agent, a dispersant, a colored dye, a release agent and a lubricant may be used, or two or more species may be selected and used.

(Barrier Layer)

In the present invention, a barrier layer may be provided on the intermediate layer, if desired, and a receiving layer is provided on this barrier layer. The solvent of the coating solution for the receiving layer is generally an organic solvent such as toluene and methyl ethyl ketone, and the barrier layer is effective as a barrier for preventing the hollow particle in the intermediate layer from collapsing through swelling or dissolution due to permeation of the organic solvent. Furthermore, the intermediate layer surface has an irregularity ascribable to the hollow particles contained in the intermediate layer, and the receiving layer provided thereon also has an irregularity in some cases, as a result, the obtained image often has white spots or irregular shading to cause a problem in the image uniformity or resolving power. In order to solve such a trouble, it is effective to provide a barrier layer containing a binder resin having flexibility and elasticity and thereby enhance the image quality.

As for the resin used in the barrier layer, a resin excellent in the film-forming ability and capable of preventing permeation of an organic solvent, and having elasticity and flexibility, is used. More specifically, a water-soluble polymer resin such as starch, modified starch, hydroxyethyl cellulose, methyl cellulose, carboxymethyl cellulose, gelatin, casein, gum arabic, fully saponified polyvinyl alcohol, partially saponified polyvinyl alcohol, carboxy-modified polyvinyl alcohol, acetoacetyl group-modified polyvinyl alcohol, isobutylene-maleic anhydride copolymer salt, styrene-maleic anhydride copolymer salt, styrene-acrylic acid copolymer salt, ethylene-acrylic acid copolymer salt, urea resin, urethane resin, melamine resin or amide resin, is used in the form of an aqueous solution. Also, a water-dispersible resin such as styrene-butadiene-based copolymer latex, acrylic acid ester resin-based latex, methacrylic acid ester-based copolymer resin latex, ethylene-vinyl acetate copolymer latex, polyester polyurethane ionomer or polyether polyurethane ionomer, may be used. One of these resins may be used alone, or two or more thereof may be used in combination.

In the intermediate layer and the barrier layer, an inorganic pigment such as inorganic white pigment, e.g., calcium carbonate, titanium dioxide, zinc oxide, aluminum hydroxide, barium sulfate, silicon dioxide, aluminum oxide, talc, kaolin, diatomaceous earth or satin white, or a fluorescent dye or the like may be incorporated so as to impart masking property or whiteness or to improve the texture of the receiving sheet. As for the inorganic pigment, a swelling inorganic layered compound is preferably used and this compound is highly effective not only for preventing the permeation of the coating solvent but also for preventing blurring or the like of the thermally transferred and dyed image. Specific examples of the swelling inorganic layered compound include graphite, a phosphate-based derivative-type compound, e.g., zirconium phosphate-based compound, a chalcogenated product, hydrotalcite compounds, a lithium-aluminum composite hydroxide, and a clay-based mineral, e.g., synthetic mica, synthetic smectite, smectite group, vermiculite group, mica group.

Among these, synthetic smectite is preferred, and sodium tetrasilicon mica is more preferred. A compound with desired particle diameter, aspect ratio and crystallinity can be obtained by a melting synthesis method.

The swelling inorganic layered compound preferably has an aspect ratio of 5 to 5,000. The aspect ratio is more preferably from 100 to 5,000, still more preferably from 500 to 5,000. If the aspect ratio is less than 5, blurring of the image may occur, whereas if the aspect ratio exceeds 5,000, the image may have poor uniformity. The aspect ratio (Z) is expressed by the relationship of $Z=L/a$, wherein L is an average particle long diameter of the swelling inorganic layered compound in water (as measured by a laser diffraction method using a particle size distribution meter, LA-910, manufactured by Horiba Ltd.; a median diameter at 50% in the volume distribution), and a is a thickness of the swelling inorganic layered compound.

The thickness a of the swelling inorganic layered compound is a value obtained by photographic observation of the cross-section of the barrier layer through a scanning electron microscope (SEM) or a transmission electron microscope (TEM). The average particle long diameter of the swelling inorganic layered compound is from 0.1 to 100 μm, preferably from 0.3 to 50 μm, more preferably from 0.5 to 20 μm. If the average particle long diameter is less than 0.1 μm, the aspect ratio becomes small and, at the same time, the compound can be hardly spread in parallel on the intermediate layer, giving rise to failure in completely preventing blurring of the image. If the average particle long diameter exceeds 100 μm, the swelling inorganic layered compound protrudes from the barrier layer to create an irregularity on the barrier layer surface, as a result, the smoothness on the receiving layer surface decreases and the image quality may be worsened.

In the present invention, the barrier layer is preferably formed by using an aqueous coating solution. In order to prevent swelling and dissolution of the hollow particle, the aqueous coating solution is preferably free of an organic solvent such as ketone-based solvent, e.g., methyl ethyl ketone, ester-based solvent, e.g., ethyl acetate, lower alcohol-based solvent, e.g., methyl alcohol, ethyl alcohol, hydrocarbon-based solvent, e.g., toluene, xylene, and high boiling point high-polarity solvent, e.g., DMF or cellosolve. The coated amount in terms of solid content of the barrier layer is preferably from 0.5 to 10 g/m$^2$, more preferably from 1 to 8 g/m$^2$. If the coated amount in terms of solid content of the barrier layer is less than 0.5 g/m$^2$, the barrier layer cannot completely cover the intermediate layer surface in some cases and the effect of preventing permeation of an organic solvent may be insufficient. On the other hand, if the coated amount in terms of solid content of the barrier layer exceeds 10 g/m$^2$, not only is the coating effect saturated, whereby this is unprofitable, but also the thickness of the barrier layer becomes excessively large, as a result, the heat insulating effect or cushioning effect of the intermediate layer may not be fully brought out and the image density may decrease.

(Receiving Layer)

In the receiving sheet of the present invention, a receiving layer is provided on the intermediate layer or through a barrier layer. The receiving layer itself may be a known dye thermal transfer receiving layer. As for the resin constituting the receiving layer, a resin having high affinity for the dye migrating from the ink ribbon and accordingly having good dye-dyeability is used. Examples of such a dye-dyeable resin include a thermoplastic resin and an active energy ray-curable resin, such as polyester resin, polycarbonate resin, polyvinyl chloride resin, vinyl chloride-vinyl acetate copolymer resin, polyvinyl acetal resin, polyvinyl butyral resin, polystyrene resin, polyacrylic acid ester resin, cellulose derivative-based resin, e.g., cellulose acetate butyrate, and polyamide resin. Such a resin preferably has a functional group having reactivity with the crosslinking agent used (for example, a functional group such as hydroxyl group, amino group, carboxyl group and epoxy group).

For the purpose of preventing the receiving layer from fusion-bonding with the ink ribbon due to heating in a thermal head, one or more species of a crosslinking agent, a release agent, a slipping agent or the like is preferably blended as the additive in the receiving layer. Also, if desired, one or more species of a plasticizer, an antioxidant, a pigment, a filler, an ultraviolet absorbent, an antistatic agent or the like may be added to the receiving layer. Such an additive may be mixed with the constituent components of the receiving layer before coating or may be coated on and/or below the receiving layer as a separate coating layer different from the receiving layer.

The coated amount in terms of solid content of the receiving layer is preferably from 1 to 12 g/m$^2$, more preferably from 3 to 10 g/m$^2$. If the coated amount in terms of solid content of the receiving layer is less than 1 g/m$^2$, the receiving layer cannot completely cover the barrier layer surface in some cases and the image quality may decrease or a fusion-bonding trouble, that the receiving layer and the ink ribbon are bonded due to heating of a thermal head, may occur. On the other hand, if the coated amount in terms of solid content exceeds 12 g/m$^2$, not only is the effect saturated, whereby this is unprofitable, but also the receiving layer comes to have insufficient coating strength or excessively large coating thickness, as a result, the heat insulating effect of the sheet-like support may not be fully exerted and the image density may decrease.

(Back Surface Layer)

In the receiving sheet of the present invention, a back surface layer may be provided on the back surface (the surface opposite the side where the receiving layer is provided) of the sheet-like support. The back surface layer mainly comprises a resin effective as an adhesive and may contain a crosslinking agent, an electrically conducting agent, a fusion-bonding inhibitor, an inorganic and/or organic pigment or the like.

For the back surface layer of the present invention, a back surface layer-forming resin effective as an adhesive is used. This resin is effective for enhancing the adhesion strength between the back surface layer and the sheet-like support, ensuring a print transporting property of the receiving sheet, preventing scratching on the receiving layer surface, and preventing migration of a dye to the back surface layer coming into contact with the receiving layer. As for such a resin, for example, an acryl resin, an epoxy resin, a polyester resin, a phenol resin, an alkyd resin, a urethane resin, a melamine resin, a polyvinyl acetal resin or a reaction cured product of such a resin may be used.

In the back surface layer of the present invention, for the purpose of enhancing the adhesion between the sheet-like support and the back surface layer, a crosslinking agent such as polyisocyanate compound and epoxy compound may be appropriately blended in the back surface layer coating material. The blending ratio thereof is, in general, preferably on the order of 1 to 30% by mass based on the entire solid content of the back surface layer.

In the back surface layer of the present invention, for the purpose of enhancing the print transporting property or preventing an electrostatic charge, an electrically conducting agent such as electrically conducting polymer and electrically conducting inorganic pigment may be added. The electrically conducting polymer includes cationic, anionic and nonionic electrically conducting polymer compounds. Examples of the cationic polymer compound include polyethyleneimine, a cationic monomer-containing acryl-based polymer, a cation-modified acrylamide polymer, and cationic starch. Examples of the anionic polymer compound include a polyacrylate, a polystyrenesulfonate and a styrene-maleic acid copolymer. In general, the blending ratio of the electrically conducting agent is preferably on the order of 5 to 50% by mass based on the entire solid content of the back surface layer.

The electrically conducting inorganic pigment includes, for example, a compound semiconductor pigment such as oxide and/or sulfide, and an inorganic pigment coated with the compound semiconductor pigment. Examples of the compound semiconductor include copper(I) oxide, zinc oxide, zinc sulfide and silicon carbide. Examples of the inorganic pigment coated with the compound semiconductor include titanium oxide and potassium titanate each coated with a semiconductor tin oxide. As for the shape, a needle-like or spherical electrically conducting inorganic pigment is available on the market.

In the back surface layer of the present invention, an organic or inorganic filler may be blended as a frictional coefficient regulator, if desired. Examples of the organic filler which can be used include nylon filler, cellulose filler, urea resin filler, styrene resin filler and acryl resin filler. Examples of the inorganic filler which can be used include silica, barium sulfate, kaolin, clay, talc, heavy calcium carbonate, precipitated calcium carbonate, titanium oxide and zinc oxide. For example, in the case of a nylon filler, the average particle diameter is preferably on the order of 1 to 25 μm and the blending amount thereof, which may vary depending on the particle diameter, is preferably on the order of 2 to 30% by mass based on the entire solid content of the back surface layer.

The back surface layer may also contain a fusion-bonding inhibitor such as lubricant and release agent, if desired. Examples of the fusion-bonding inhibitor include a silicone-based compound such as non-modified or modified silicone oil, silicone block copolymer and silicone rubber, a phosphoric acid ester compound, a fatty acid ester compound and a fluorine compound. Furthermore, a conventionally-known defoaming agent, dispersant, colored pigment, fluorescent dye, fluorescent pigment, ultraviolet absorbent and the like may be appropriately selected and used.

The coated amount in terms of solid content of the back surface layer is preferably from 0.3 to 10 g/m$^2$, more preferably from 1 to 8 g/m$^2$. If the coated amount in terms of solid content of the back surface layer is less than 0.3 g/m$^2$, the property of preventing scratching when the receiving sheet is rubbed may not be fully brought out and also, a coating defect may be generated to cause increase in the surface electric resistivity, whereas if the coated amount in terms of solid content exceeds 10 g/m$^2$, the effect is saturated, whereby it is unprofitable.

(Undercoat Layer)

In the receiving sheet of the present invention, an undercoat layer mainly comprising a polymer resin may be provided between the support and the intermediate layer. By virtue of this undercoat layer, even when the coating solution for the intermediate layer is coated on the support, the coating solution does not permeate into the support and the intermediate layer can be formed to a desired thickness. Examples of the polymer resin for use in the undercoat layer include an acryl resin, a polyurethane resin, a polyester resin, a polyolefin resin, and a modified resin thereof.

In the case where, for example, a paper substrate is used as the support in the present invention, when an undercoat layer comprising an aqueous coating solution is coated, wrinkling or undulation may be generated in the paper substrate due to uneven water absorption of the paper substrate surface and adversely affect the texture or printability. Accordingly, in such a case, the coating solution for the undercoat layer is preferably not an aqueous coating solution but a coating solution prepared by dissolving or dispersing a polymer resin in an organic solvent. Examples of the organic solvent which can used include a general organic solvent such as toluene, methyl ethyl ketone, isopropyl alcohol and ethyl acetate.

Also, an inorganic white pigment such as titanium dioxide, calcium carbonate and barium sulfate may be added in the undercoat layer so as to improve the coatability of the undercoat layer coating solution itself, enhance the adhesion to the support and the intermediate layer and elevate the whiteness of the receiving sheet. The coated amount in terms of solid content of the undercoat layer is preferably from 1 to 20 g/m$^2$. If the coated amount in terms of solid content is less than 1 g/m$^2$, the effect of the undercoat layer may not be obtained, whereas if the coated amount in terms of solid content exceeds 20 g/m$^2$, the effect of the undercoat layer may be saturated, whereby is unprofitable, or the receiving sheet may lose a paper texture.

The method for producing a receiving sheet of the present invention preferably comprises at least the following steps.

That is, the production method comprises the steps of, after (a) providing the intermediate layer by coating an intermediate layer coating solution comprising a hollow particle having an average particle diameter of 0.2 to 35 μm and a hollow percentage by volume of 30 to 97% on at least one surface of the sheet-like support and drying it and/or after (b) providing the image receiving layer on the intermediate layer, (c) applying a smoothing treatment step of passing the sheet through a nip part having a pair of rolls consisting of a heating roll and a press roll, wherein the printing smoothness (Rp value) on the receiving sheet surface as measured by using a Microtopograph under an applied pressure of 0.1 MPa 10 milli-seconds after the initiation of pressure application is adjusted to 1.5 μm or less.

Furthermore, after the step (a) of providing the intermediate layer, a barrier layer is preferably provided on the intermediate layer, and a receiving layer is provided on the barrier layer. Also, the production method may comprise a step of providing a back surface layer on the side of the sheet-like support in which the receiving layer is not provided.

In the present invention, the intermediate layer, the barrier layer, the receiving layer, the back surface layer and other coating layers are formed according a conventional method and each layer may be formed by preparing a coating solution containing required components, coating the coating solution on a predetermined surface of the sheet-like support by use of a known coater such as bar coater, gravure coater, comma coater, blade coater, air knife coater, gate roll coater, die coater, curtain coater, lip coater and slide bead coater, drying it and, if desired, heat-curing the coating.

For example, in coating the intermediate layer, a molded surface may be used or a high-smoothness surface with good dimensional stability, such as metal plate, metal drum and plastic film, may be used. If desired, in order to facilitate the separation of the intermediate layer from the molded surface, a higher fatty acid-based release agent such as calcium stearate and zinc stearate, a polyethylene-based release agent such as polyethylene emulsion, or a release agent such as wax and silicone, may be coated on the molded surface.

The method for producing a receiving sheet of the present invention preferably comprises a smoothing treatment step.

The smoothing treatment is preferably performed by passing the receiving sheet through a pair of rolls consisting of a heating roll and a press roll with a fixed clearance, thereby decreasing the irregularity on the receiving sheet surface, and then performing a calendering treatment of smoothing the surface. At this time, heat and pressure may be applied between the paired rolls.

The smoothing treatment may be sufficient if the printing smoothness (Rp value) on the surface of the finally obtained receiving sheet as measured by using Microtopograph under an applied pressure of 0.1 MPa 10 milli-seconds after the initiation of pressure application becomes 1.5 μm or less. The smoothing treatment may be applied to any of the sheet-like support surface, the intermediate layer surface, the barrier layer surface, the receiving layer surface and the like. In particular, the smoothing treatment is preferably applied to the intermediate layer surface or the receiving layer surface. Also, the smoothing treatment may be of course applied to two or more kinds of surfaces.

The calendering apparatus used in the smoothing treatment and various treatment conditions such as nip pressure, number of nips and the surface temperature of heating roll, are not particularly limited but, as for the calendering apparatus, a calendering apparatus generally used in the paper-making industry, such as super calender, soft calender, gloss calender, machine calender and clearance calender, may be appropriately used.

In the smoothing treatment, the nip pressure condition is preferably, for example, from 0.2 to 150 MPa, more preferably from 0.3 to 100 MPa. The residence time of the receiving sheet in the nip part is greatly affected by the hardness of press roll, the linear pressure of calender, the treating speed or the like but is preferably from 5 to 500 milli-seconds. As for the temperature condition of the heating roll, a temperature range from room temperature to the melting point of the binder in the coating layer subjected to the smoothing treatment is preferred, and this is, for example, from 20 to 150° C., more preferably from 30 to 120° C. Also, as for the surface roughness of the heating roll, the Ra value based on JIS B 0601 is preferably from 0.01 to 5 μm, more preferably from 0.02 to 1 μm.

The method for producing a receiving sheet of the present invention may comprise, as shown in FIG. 1, a thickness restoring treatment step of, after the smoothing treatment step, subsequently heating the receiving sheet by contacting the sheet with a heating roll in a pressure released state. When a smoothing treatment is applied by passing the receiving sheet through a nip part in an applied pressure state formed between a pair of rolls consisting of a heating roll and a press roll, the smoothness is enhanced, but the inside, particularly the intermediate layer, of the receiving sheet is compressed and the thickness decreases. When the receiving sheet immediately after the passing through the nip part is brought into contact with a heating roll in a pressure released state, the intermediate layer in particular expands and the thickness increases, so that the density of the entire intermediate layer can be decreased and the printing density of the receiving sheet can be elevated.

The temperature of the heating roll in the thickness restoring treatment step may be the same as the condition of the heating roll in the above-described smoothing treatment and is preferably from 20 to 150° C., more preferably from 30 to 120° C. Also, the contact time of the receiving sheet with the heating roll is preferably 0.5 seconds or more, more preferably 1 second or more.

(Image Forming Method)

In a sublimation thermal transfer printer available on the market at present, when a sublimable dye is thermally transferred to the receiving layer of a receiving sheet from an ink ribbon to form an image, a pressure of approximately from 0.1 to 0.5 MPa is applied to the receiving sheet due to a pressing pressure between the thermal head and the platen roll of a printer.

The receiving sheet of the present invention is preferably subjected to a pressure treatment of applying a pressure of 1.0 MPa or more to the receiving sheet surface during and/or after printing so as to enhance the strength of the printed matter surface. A pressure treatment of 1.5 to 5 MPa is more preferred.

Examples of the pressure treatment for the receiving sheet surface include the following methods (1) to (4):

(1) after printing under normal conditions, a predetermined pressure treatment is applied to the receiving sheet by adjusting the nip roll pressure;

(2) after printing under normal conditions, a predetermined pressure and paper-passing treatment is applied to the receiving sheet by adjusting the pressing pressure of the platen roll;

(3) in the case where the printing method is a three-cycle transfer processing of yellow, magenta and cyan, a predetermined pressure and transfer treatment is applied to the receiving sheet by adjusting the pressing pressure of the platen roll at the final transfer of cyan; and (4) in the case where the printing method is a four-cycle transfer processing of yellow, magenta, cyan and transparent protective layer, a predetermined pressure and transfer treatment is applied to the receiving sheet by adjusting the pressing pressure of the platen roll at the final transfer of a transparent protective layer.

These systems are appropriately selected by taking account of the cost of apparatus, the processing speed and the easiness of control.

EXAMPLES

The present invention is described in greater detail below by referring to Examples, but the scope of the present invention is not limited thereto. In Examples, unless otherwise indicated, the "%" and "parts" indicate "mass %" and "parts by mass" in terms of solid content, excluding those for a solvent.

Example 1

[Formation of Back Surface Layer ]

Using a 150 μm-thick art paper (OK Kinfuji N, trade name, produced by Oji Paper Co., Ltd., 174.4 g/m$^2$) as the sheet-like support, Back Surface Layer Coating Solution 1 having the following composition was coated on one surface thereof to have a dry coated amount in terms of solid content of 3 g/m$^2$, and dried to form a back surface layer.

| Back Surface Layer Coating Solution 1 | |
|---|---|
| Polyvinyl acetal resin (ESLEC KX-1, produced by Sekisui Chemical Co., Ltd.) | 40 parts |
| Polyacrylic acid ester resin (JURYMER AT613, trade name, produced by Nihon Junyaku Co., Ltd.) | 20 parts |
| Nylon resin particles (MW330, trade name, produced by Shinto Toryo Co., Ltd.) | 10 parts |
| Zinc stearate (Z-7-30, trade name, produced by Chukyo Yushi Co., Ltd.) | 10 parts |
| Cationic electrically conducting resin (CHEMISTAT 9800, trade name, produced by Sanyo Chemical Industries Co., Ltd.) | 20 parts |
| A 2/3 (by mass) mixed solution of water/isopropyl alcohol | 400 parts |

[Formation of Intermediate Layer]

On the sheet-like support surface opposite the side where the back surface layer was provided, Intermediate Layer Coating Solution 1 having the following composition was coated to have a dry thickness of 43 μm and dried to form an intermediate layer. Furthermore, for smoothing the surface, the sheet was subjected to a calendering treatment (roll surface temperature: 80° C., nip pressure: 2.5 MPa).

| Intermediate Layer Coating Solution 1 | |
|---|---|
| Polyvinylidene chloride-based prefoamed hollow particles (hollow percentage by volume: 93%, average particle diameter: 4 μm, maximum particle diameter: 20 μm) | 35 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 50 parts |
| Water | 200 parts |

[Preparation of Receiving Sheet]

On the intermediate layer, Barrier Layer Coating Solution 1 having the following composition was coated to have a coated amount in terms of solid content of 2 g/m$^2$ and dried to form a barrier layer. Subsequently, on the barrier layer, Receiving Layer Coating Solution 1 having the following composition was coated to have a coated amount in terms of solid content of 5 g/m$^2$ and dried. The formed coating was then cured at 50° C. for 48 hours to form a receiving layer. In this way, a receiving sheet was prepared.

| Barrier Layer Coating Solution 1 | |
|---|---|
| Polyvinyl alcohol (PVA420, trade name, produced by Kuraray Co., Ltd.) | 100 parts |
| Water | 1,000 parts |

| Receiving Layer Coating Solution 1 | |
|---|---|
| Polyester resin (VYLON 200, trade name, produced by Toyobo Co., Ltd.) | 100 parts |
| Silicone oil (KF393, trade name, produced by Shin-Etsu Chemical Co., Ltd.) | 3 parts |
| Polyisocyanate (TAKENATE D-140N, trade name, produced by Mitsui Takeda Chemical Industries, Ltd.) | 5 parts |
| A 1/1 (by mass) mixed solution of toluene/methyl ethyl ketone | 400 parts |

[Image Forming Processing]

Using a commercially available thermal transfer video printer (UP-DR100, trade name, manufactured by Sony Corp.), ink layers for three colors of an ink ribbon comprising a 6 μm-thick polyester film having provided thereon ink layers each comprising a sublimable dye of yellow, magenta or cyan and a binder were sequentially contacted with the receiving sheet and subjected to heating stepwise controlled by a thermal head to thermally transfer a predetermined image to the receiving sheet, whereby a halftone monochromatic image of each color or a color mixed image was printed. The obtained image sheet was passed between a metal roll (contacted to the printing surface; diameter: 30 mm) and a rubber roll (contacted to the back surface; diameter: 30 mm) under an applied pressure of 1.5 MPa.

Example 2

A receiving sheet was prepared and the receiving sheet after printing was subjected to a pressure treatment in the same manner as in Example 1 except that in the formation of the intermediate layer, Intermediate Layer Coating Solution 2 having the following composition was coated to have a dry thickness of 25 μm and dried to form the intermediate layer.

| Intermediate Layer Coating Solution 2 | |
|---|---|
| Copolymer-based prefoamed hollow particles mainly comprising acrylonitrile and acrylic acid ester (hollow percentage by volume: 79%, average particle diameter: 3.6 μm, maximum particle diameter: 19 μm) | 35 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 50 parts |
| Water | 200 parts |

Example 3

A receiving sheet was prepared and the receiving sheet after printing was subjected to a pressure treatment in the same manner as in Example 1 except that in the formation of the intermediate layer, Intermediate Layer Coating Solution 3 having the following composition was coated to have a dry thickness of 40 μm and dried to form the intermediate layer.

| Intermediate Layer Coating Solution 3 | |
|---|---|
| Copolymer-based prefoamed hollow particles mainly comprising acrylonitrile and acrylic acid ester (hollow percentage by volume: 79%, average particle diameter: 3.6 μm, maximum particle diameter: 19 μm) | 55 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 30 parts |
| Water | 200 parts |

Example 4

A receiving sheet was prepared and the receiving sheet after printing was subjected to a pressure treatment in the same manner as in Example 1 except that in the formation of the intermediate layer, Intermediate Layer Coating Solution 4 having the following composition was coated to have a dry thickness of 50 μm and dried to form the intermediate layer.

| Intermediate Layer Coating Solution 4 | |
|---|---|
| Copolymer-based prefoamed hollow particles mainly comprising acrylonitrile and acrylic acid ester (hollow percentage by volume: 80%, average particle diameter: 8.0 μm, maximum particle diameter: 25 μm) | 35 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 50 parts |
| Water | 200 parts |

Example 5

A receiving sheet was prepared and the receiving sheet after printing was subjected to a pressure treatment in the same manner as in Example 1 except that in the formation of the intermediate layer, Intermediate Layer Coating Solution 5 having the following composition was coated to have a dry thickness of 65 μm and dried to form the intermediate layer.

| Intermediate Layer Coating Solution 5 | |
|---|---|
| Copolymer-based prefoamed hollow particles mainly comprising acrylonitrile and acrylic acid ester (hollow percentage by volume: 88%, average particle diameter: 4.4 μm, maximum particle diameter: 20 μm) | 55 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 30 parts |
| Water | 200 parts |

Example 6

A receiving sheet was prepared and the receiving sheet after printing was subjected to a pressure treatment in the same manner as in Example 1 except that in the formation of the intermediate layer, Intermediate Layer Coating Solution 6 having the following composition was coated to have a dry thickness of 33 μm and dried to form the intermediate layer.

| Intermediate Layer Coating Solution 6 | |
|---|---|
| Copolymer-based prefoamed hollow particles mainly comprising acrylonitrile and acrylic acid ester (hollow percentage by volume: 77%, average particle diameter: 5.2 μm, maximum particle diameter: 24 μm) | 45 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 40 parts |
| Water | 200 parts |

Example 7

After printing was performed as follows by using a receiving sheet prepared in the same manner as in Example 1, a pressure treatment was applied at the formation of a protective layer.

[Image Forming Processing]

Using a commercially available thermal transfer video printer (thermal head/platen roller pressure: 0.8 MPa), ink layers for three colors of an ink ribbon comprising a 6 μm-thick polyester film having provided thereon ink layers each comprising a sublimable dye of yellow, magenta or cyan and a binder were sequentially contacted with the receiving sheet and subjected to heating stepwise controlled by a thermal head to thermally transfer a predetermined image to the receiving sheet, whereby a halftone monochromatic image of each color or a color mixed image was printed.

After adjusting the pressure between the thermal head and the platen roll to 4.5 MPa, the obtained image sheet was passed therebetween. At this time, a sheet comprising a 6 μm-thick polyester film having provided thereon a transparent resin layer was contacted with the receiving sheet and heated by the thermal head, thereby thermally transferring a protective layer to the receiving sheet.

Example 8

An image forming processing was performed in the same manner as in Example 7 except that after performing printing by using a receiving sheet prepared in the same manner as in Example 1, a protective layer was thermally transferred to the receiving sheet by not changing the pressure (0.8 MPa) between the thermal head and the platen roll.

Example 9

[Formation of Back Surface Layer]

Using a 150 μm-thick art paper (OK Kinfuji N, trade name, produced by Oji Paper Co., Ltd., 174.4 g/m$^2$) as the sheet-like support, Back Surface Layer Coating Solution 1 (prepared in Example 1) was coated on one surface thereof to have a coated amount in terms of solid content of 3 g/m$^2$, and dried to form a back surface layer.

[Formation of Intermediate Layer]

On the sheet-like support surface opposite the side where the back surface layer was provided, Intermediate Layer Coating Solution 2 (prepared in Example 2) was coated to have a dry thickness of 53 μm and dried to form an intermediate layer.

[Preparation of Receiving Sheet]

On the intermediate layer, Barrier Layer Coating Solution 1 (prepared in Example 1) was coated to have a coated amount in terms of solid content of 2 g/m$^2$ and dried to form a barrier layer. Subsequently, on the barrier layer, Receiving Layer Coating Solution 1 (prepared in Example 1) was coated to have a coated amount in terms of solid content of 5 g/m$^2$ and dried. The formed coating was then cured at 50° C. for 48 hours to form a receiving layer. Furthermore, for smoothing the surface, the sheet was subjected to a calendering treatment (roll surface temperature: 78° C., nip pressure: 2.5 MPa). In this way, a receiving sheet was prepared.

[Image Forming Processing]

Printing was performed in the same manner as in Example 7 by using the receiving sheet obtained above and then a pressure was applied at the formation of a protective layer, thereby completing the image forming processing.

Example 10

The image forming processing was performed in the same manner as in Example 9 except that the receiving sheet was prepared by changing "Preparation of Receiving Sheet" in Example 9 as follows.

[Preparation of Receiving Sheet]

On the intermediate layer obtained after "Formation of Back Surface Layer" and "Formation of Intermediate Layer" in Example 9, Barrier Layer Coating Solution 1 (prepared in Example 1) was coated to have a coated amount in terms of solid content of 2 g/m$^2$ and dried to form a barrier layer. Subsequently, on the barrier layer, Receiving Layer Coating Solution 1 (prepared in Example 1) was coated to have a coated amount in terms of solid content of 5 g/m$^2$ and dried. The formed coating was then cured at 50° C. for 48 hours to form a receiving layer. Furthermore, for smoothing the receiving layer surface, the sheet was subjected to a calendering treatment (roll surface temperature: 78° C., nip pressure: 2.5 MPa). Immediately, the receiving layer surface was contacted with a roll at a surface temperature of 78° C. for 2 seconds under released pressure to effect a thickness restoring treatment. In this way, a receiving sheet was obtained.

[Image Forming Processing]

Printing was performed in the same manner as in Example 7 by using the receiving sheet obtained above and then a pressure was applied at the formation of a protective layer, thereby completing the image forming processing.

Example 11

Formation of Back Surface Layer

Using a 150 μm-thick art paper (OK Kinfuji N, trade name, produced by Oji Paper Co., Ltd., 174.4 g/m$^2$) as the sheet-like support, Back Surface Layer Coating Solution 1 (prepared in Example 1) was coated on one surface thereof to have a dry coated amount in terms of solid content of 3 g/m$^2$, and dried to form a back surface layer.

[Formation of Intermediate Layer]

On the sheet-like support surface opposite the side where the back surface layer was provided, Intermediate Layer Coating Solution 5 (prepared in Example 5) was coated to have a dry thickness of 65 μm and dried to form an intermediate layer.

[Preparation of Receiving Sheet]

On the intermediate layer, Barrier Layer Coating Solution 1 (prepared in Example 1) was coated to have a coated amount in terms of solid content of 2 g/m$^2$ and dried to form a barrier layer. Subsequently, on the barrier layer, Receiving Layer Coating Solution 1 (prepared in Example 1) was coated to have a coated amount in terms of solid content of 5 g/m$^2$ and dried. The formed coating was then cured at 50° C. for 48 hours to form a receiving layer. Furthermore, for smoothing the receiving layer surface, the sheet was subjected to a calendering treatment (roll surface temperature: 78° C., nip pressure: 2.5 MPa). Immediately, the receiving layer surface was contacted with a roll at a surface temperature of 78° C. for 2 seconds under released pressure to effect a thickness restoring treatment. In this way, a receiving sheet was obtained.

[Image Forming Processing]

Printing was performed in the same manner as in Example 7 by using the receiving sheet obtained above and then a pressure was applied at the formation of a protective layer, thereby completing the image forming processing.

Comparative Example 1

A receiving sheet was prepared and the receiving sheet after printing was subjected to a pressure treatment in the same manner as in Example 1 except that, in the formation of the intermediate layer, Intermediate Layer Coating Solution 7 having the following composition was coated to have a dry thickness of 35 μm and dried to form the intermediate layer.

| Intermediate Layer Coating Solution 7 | |
|---|---|
| Copolymer-based prefoamed hollow particles mainly comprising acrylonitrile and acrylic acid ester (hollow percentage by volume: 97%, average particle diameter: 4.4 μm, maximum particle diameter: 20 μm) | 35 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 50 parts |
| Water | 200 parts |

Comparative Example 2

A receiving sheet was prepared and the receiving sheet after printing was subjected to a pressure treatment in the same manner as in Example 1 except that in the formation of the intermediate layer, Intermediate Layer Coating Solution 8 having the following composition was coated to have a dry thickness of 20 μm and dried to form the intermediate layer.

| Intermediate Layer Coating Solution 8 | |
|---|---|
| Polyvinyl alcohol (PVA205, trade name, produced by Kuraray Co., Ltd.) | 15 parts |
| Styrene-butadiene latex (PT1004, trade name, produced by Nippon ZEON Corporation) | 85 parts |
| Water | 200 parts |

Comparative Example 3

A receiving sheet was prepared and the receiving sheet after printing was subjected to a pressure treatment in the same manner as in Example 1 except that in the formation of the intermediate layer, Intermediate Layer Coating Solution 9 having the following composition was used.

| Intermediate Layer Coating Solution 9 | |
|---|---|
| Copolymer-based prefoamed hollow particles mainly comprising acrylonitrile and acrylic acid ester (hollow percentage by volume: 77%, average particle diameter: 15.0 μm, maximum particle diameter: 35 μm) | 35 parts |

-continued

| Intermediate Layer Coating Solution 9 | |
|---|---|
| Polyvinyl alcohol (PVA205, trade name, produced by Kuraray Co., Ltd.) | 15 parts |
| Styrene-butadiene latex (PT1004, trade name, produced by Nippon ZEON Corporation) | 50 parts |
| Water | 200 parts |

Comparative Example 4

A receiving sheet was prepared and the receiving sheet after printing was subjected to a pressure treatment in the same manner as in Example 1 except that in the formation of the intermediate layer, Intermediate Layer Coating Solution 10 having the following composition was coated to have a dry thickness of 60 μm and dried to form the intermediate layer.

| Intermediate Layer Coating Solution 10 | |
|---|---|
| Copolymer-based prefoamed hollow particles mainly comprising acrylonitrile and acrylic acid ester (hollow percentage by volume: 65%, average particle diameter: 5.2 μm, maximum particle diameter: 24 μm) | 30 parts |
| Polyvinyl alcohol (PVA205, trade name, produced by Kuraray Co., Ltd.) | 15 parts |
| Styrene-butadiene latex (PT1004, trade name, produced by Nippon ZEON Corporation) | 55 parts |
| Water | 200 parts |

Comparative Example 5

A receiving sheet was prepared and the receiving sheet after printing was subjected to a pressure treatment in the same manner as in Example 4.

However, in the formation of the intermediate layer, a calendering treatment for surface smoothing was not performed.

Evaluation

The receiving sheets obtained in Examples and Comparative Examples each was evaluated by the following methods and the results obtained are shown in Table 1.

[Printing Smoothness]

The printing smoothness (Rp value) under an applied pressure of 0.1 MPa after 10 milli-seconds from the initiation of pressure application was measured by using a printing smoothness tester (Microtopograph, manufactured by Toyo Seiki Seisaku-Sho, Ltd.).

[Compressive Modulus of Elasticity]

The compressive modulus of elasticity of the receiving sheet was measured according to JIS K 7220 (Testing Method for Compressive Properties of Rigid Cellular Plastics). However, the height (thickness) of the specimen was the thickness of the tested receiving sheet (about 200 μm). Also, the compression speed was 20 μm/min.

[Printing Quality (1)] (Printing Density, Image Uniformity)

Using the printed matters obtained in Examples and Comparative Examples, the reflection density of the recorded image transferred to the receiving sheet was measured by a Macbeth reflection densitometer (RD-914, trade name, manufactured by Kollmorgen) with respect to each applied energy. The density in the high gradation part corresponding to the 15th step from the lower side of the applied energy is shown as the printing density in Table 1.

Furthermore, the uniformity of the recorded image was evaluated by observing with an eye whether irregular shading and white spot were present or not in the gradation portion corresponding to an optical density (black) of 0.3.

The evaluation results were rated Ex. when excellent, Good when good, Fair when irregular shading and white spot were slightly observed, or Poor when defects of irregular shading and white spot were serious.

[Evaluation of Scratching]

The surface of the printed matter obtained in each of Examples and Comparative Examples was scratched with a nail, and the ease of forming of a scratch mark was evaluated with an eye. The evaluation results were rated Ex. when excellent, Good when good, Fair when scratch mark was slightly observed, or Poor when scratch mark was serious.

TABLE 1

| | Hollow Particles of Intermediate Layer | | | Intermediate Layer | | Printing | Compressive | Treatment of |
|---|---|---|---|---|---|---|---|---|
| | Average Particle Diameter, μm | Maximum Particle Diameter, μm | Hollow Percentage by Volume, % | Hollow Particle Content, % | Thickness, μm | Smoothness Rp Vale, μm | Modulus of Elasticity, MPa | Applying Printing Pressure |
| Example 1 | 4.0 | 20 | 93 | 35 | 43 | 1.0 | 14 | applied |
| Example 2 | 3.6 | 19 | 79 | 35 | 25 | 1.2 | 18 | applied |

TABLE 1-continued

| | Hollow Particles of Intermediate Layer | | | Intermediate Layer | | Printing | Compressive | Treatment of |
|---|---|---|---|---|---|---|---|---|
| | Average Particle Diameter, μm | Maximum Particle Diameter, μm | Hollow Percentage by Volume, % | Hollow Particle Content, % | Thickness, μm | Smoothness Rp Vale, μm | Modulus of Elasticity, MPa | Applying Printing Pressure |
| Example 3 | 3.6 | 19 | 79 | 55 | 40 | 1.0 | 18 | applied |
| Example 4 | 8.0 | 25 | 80 | 35 | 50 | 1.2 | 16 | applied |
| Example 5 | 4.4 | 20 | 88 | 55 | 65 | 0.9 | 13 | applied |
| Example 6 | 5.2 | 24 | 77 | 45 | 33 | 1.2 | 17 | applied |
| Example 7 | 4.0 | 20 | 93 | 35 | 43 | 1.0 | 14 | applied |
| Example 8 | 4.0 | 20 | 93 | 35 | 43 | 1.0 | 14 | none |
| Example 9 | 3.6 | 19 | 79 | 35 | 53 | 0.9 | 28 | applied |
| Example 10 | 3.6 | 19 | 79 | 35 | 53 | 0.8 | 21 | applied |
| Example 11 | 4.4 | 20 | 88 | 55 | 65 | 0.8 | 11 | applied |
| Comparative Example 1 | 4.4 | 20 | 97 | 35 | 35 | 2.8 | 17 | applied |
| Comparative Example 2 | — | — | — | — | 20 | 0.8 | 30 | applied |
| Comparative Example 3 | 15.0 | 35 | 77 | 35 | 43 | 5.2 | 18 | applied |
| Comparative Example 4 | 5.2 | 24 | 65 | 30 | 60 | 3.2 | 21 | applied |
| Comparative Example 5 | 8.0 | 25 | 80 | 35 | 50 | 2.0 | 16 | applied |

As apparent from Table 1, the receiving sheets obtained in Examples of the present invention were suitable for practical use in view of printing density, image uniformity and the like. In Example 8 where a pressure treatment of the printed matter was not applied, a scratch mark was slightly observed in Evaluation of Scratching, but this was in the level of causing no problem in practice.

On the other hand, the receiving sheets obtained in Comparative Examples 1 to 5 were insufficient in the printing density or image uniformity and not suitable for practical use.

Example 12

[Formation of Intermediate Layer]

Using a 150 μm-thick art paper (OK Kinfuji N, trade name, produced by Oji Paper Co., Ltd., 174.4 g/m$^2$) as the sheet-like support, Intermediate Layer Coating Solution 11 having the following composition was coated on one surface thereof to have a dry thickness of 48 μm and dried to form an intermediate layer.

| Intermediate Layer Coating Solution 11 | |
|---|---|
| Hollow particles A: prefoamed hollow particle mainly comprising polyacrylonitrile (average particle diameter: 3.8 μm, coefficient of variation in particle diameter: 14%, hollow percentage by volume: 75%) | 65 parts |
| Hollow particles B: microcapsule-type hollow particle (Nipol MH-5055, trade name, produced by Nippon ZEON Corporation, average particle diameter: 0.55 μm, coefficient of variation in particle diameter: 15%, hollow percentage by volume: 55%) | 0.5 parts |
| Polyvinyl alcohol (PVA205, trade name, produced by Kuraray Co., Ltd.) | 10 parts |

-continued

| Intermediate Layer Coating Solution 11 | |
|---|---|
| Styrene-butadiene latex (PT1004, trade name, produced by Nippon ZEON Corporation) | 24.5 parts |
| Water | 200 parts |

[Preparation of Thermal Transfer Receiving Sheet]

On the intermediate layer, Barrier Layer Coating Solution 2 having the following composition was coated to have a coated amount in terms of solid content of 2 g/m$^2$ and dried to form a barrier layer. Subsequently, on the barrier layer, Receiving Layer Coating Solution 1 (prepared in Example 1) was coated to have a coated amount in terms of solid content of 5 g/m$^2$ and dried. The formed coating was then cured at 50° C. for 72 hours to form a receiving layer. Furthermore, on the sheet-like support surface opposite the receiving layer-coated surface, Back Surface Layer Coating Solution 2 having the following composition was coated to have a coated amount in terms of solid content of 3 g/m$^2$ and dried to form a back surface layer. In this way, a receiving sheet was obtained.

| Barrier Layer Coating Solution 2 | |
|---|---|
| Swelling inorganic layered compound (sodium tetrasilicon mica, average particle long diameter: 6.3 μm, aspect ratio: 2,700) | 30 parts |
| Polyvinyl alcohol (PVA105, trade name, produced by Kuraray Co., Ltd.) | 50 parts |
| Styrene-butadiene latex (L-1537, trade name, produced by Asahi Kasei Corporation) | 20 parts |
| Water | 1,100 parts |

| Back Surface Layer Coating Solution 2 | |
|---|---|
| Polyvinyl acetal resin (ESLEC KX-1, produced by Sekisui Chemical Co., Ltd.) | 45 parts |
| Polyacrylic acid ester resin (JURYMER AT613, trade name, produced by Nihon Junyaku Co., Ltd.) | 25 parts |
| Nylon resin particles (MW330, trade name, produced by Shinto Toryo Co., Ltd.) | 10 parts |
| Zinc stearate (Z-7-30, trade name, produced by Chukyo Yushi Co., Ltd.) | 10 parts |
| Cationic electrically conducting resin (CHEMISTAT 9800, trade name, produced by Sanyo Chemical Industries Co., Ltd.) | 10 parts |
| A ⅔ (by mass) mixed solution of water/isopropyl alcohol | 400 parts |

Example 13

A receiving sheet was obtained in the same manner as in Example 12 except for changing "Formation of Intermediate Layer" as follows.

[Formation of Intermediate Layer]

Using a 150 μm-thick art paper (OK Kinfuji N, trade name, produced by Oji Paper Co., Ltd., 174.4 g/m$^2$) as the sheet-like support, Intermediate Layer Coating Solution 12 having the following composition was coated on one surface thereof to have a dry thickness of 48 μm and dried to form an intermediate layer.

| Intermediate Layer Coating Solution 12 | |
|---|---|
| Hollow particles A: prefoamed hollow particle mainly comprising polyacrylonitrile (average particle diameter: 3.8 μm, coefficient of variation in particle diameter: 14%, hollow percentage by volume: 75%) | 65 parts |
| Hollow particles B: microcapsule-type hollow particle (ROHPAKE HP-1055, trade name, produced by Rohm & Haas, average particle diameter: 1.0 μm, coefficient of variation in particle diameter: 12%, hollow percentage by volume: 55%) | 3 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 22 parts |
| Water | 200 parts |

Evaluation

The receiving sheets obtained in Examples above each was evaluated by the following methods and the results obtained are shown in Table 2.

[Printing Quality (2)] (Printing Density, Image Uniformity)

Using a commercially available thermal transfer video printer (DPP-SV55, trade name, manufactured by Sony Corp.), each color ink layer of an ink ribbon comprising a 6 μm-thick polyester film having sequentially provided thereon three color ink layers each comprising a sublimable dye of yellow, magenta or cyan and a binder was contacted with the receiving sheet surface and subjected to heating stepwise controlled by a thermal head to thermally transfer a predetermined image to the receiving sheet, whereby a half-tone monochromatic image of each color or a color mixed image was printed.

The reflection density of the recorded image transferred to the receiving sheet was measured by a Macbeth reflection densitometer (RD-914, trade name, manufactured by Kollmorgen) with respect to each applied energy. The density in the high gradation part corresponding to the 15th step from the lower side of the applied energy is shown as the printing density in Table 2. When the printing density is 2.0 or more, the receiving sheet is sufficiently suited for practical use.

Furthermore, the uniformity of the recorded image in the gradation portion corresponding to an optical density (black) of 0.3 was evaluated by observing with an eye whether irregular shading and white spot were present or not. The evaluation results were rated Ex. when excellent, Good when good, Fair when irregular shading and white spot were slightly observed, or Poor when defects of irregular shading and white spots were serious.

[Dent of Receiving Sheet]

By modifying a commercially available thermal transfer video printer (M1, trade name, manufactured by Sony Corp.), the nip pressure of the transporting roll was elevated. The nip pressure measured by using a pressure test film (PRESCALE, trade name, produced by Fuji Photo Film Co., Ltd.) was 50 kg/cm$^2$. The dent of the receiving sheet due to the transporting roll of this tester was evaluated with an eye.

Rating was Ex. when dent was not observed at all, Good when dent was scarcely observed, or Poor when dent was serious.

When these evaluation results are at the Good level or higher, the receiving sheet is sufficiently suited for practical use.

TABLE 2

| | Hollow Particles A | | | | Hollow Particles B | | | |
|---|---|---|---|---|---|---|---|---|
| | Average Particle Diameter $L_A$ (μm) | Coefficient Variation in Particle Diameter (%) | Hollow Percentage by Volume (%) | Blending Parts by Number (parts) | Average Particle Diameter $L_B$ (μm) | Coefficient of Variation in Particle Diameter (%) | Hollow Percentage by Volume (%) | Blending Parts by Number (parts) |
| Example 12 | 3.8 | 14 | 75 | 65 | 0.55 | 15 | 55 | 0.5 |
| Example 13 | 3.8 | 14 | 75 | 65 | 1 | 12 | 55 | 3 |

| | Particle Diameter Ratio $L_B/L_A$ of Hollow Particles | Printing Smoothness Rp Value (μm) | Printing Density | Image Uniformity | Receiving Sheet (dent) | Blurring of Image |
|---|---|---|---|---|---|---|
| Example 12 | 0.14 | 1.0 | 2.11 | Ex. | Good | Good |
| Example 13 | 0.26 | 1.0 | 2.11 | Ex. | Ex. | Good |

Example 14

[Formation of Intermediate Layer]

Using a 150 μm-thick art paper (OK Kinfuji N, trade name, produced by Oji Paper Co., Ltd., 174.4 g/m$^2$) as the sheet-like support, Intermediate Layer Coating Solution 13 having the following composition was coated on one surface thereof to have a dry thickness of 51 μm and dried to form an intermediate layer.

| Intermediate Layer Coating Solution 13 | |
|---|---|
| Prefoamed hollow particles formed of a copolymer mainly comprising acrylonitrile and methacrylonitrile (average particle diameter: 3.2 μm, hollow percentage by volume: 76%, Tg of partition wall resin: 152° C.) | 45 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 45 parts |
| Water | 250 parts |

[Formation of Barrier Layer and Receiving Layer]

On the intermediate layer, Barrier Layer Coating Solution 2 (prepared in Example 12) was coated to have a coated amount in terms of solid content of 2 g/m$^2$ and dried to form a barrier layer. Subsequently, on the barrier layer, Receiving Layer Coating Solution 1 (prepared in Example 1) was coated to have a coated amount in terms of solid content of 5 g/m$^2$ and dried to form a receiving layer.

[Preparation of Receiving Sheet Layer]

On the sheet-like support surface opposite the side where the receiving layer was provided, Back Surface Layer Coating Solution 1 (prepared in Example 1) was coated to have a dry coated amount in terms of solid content of 3 g/m$^2$ and dried to form a back surface layer. Thereafter, the sheet was cured at 50° C. for 48 hours to form a receiving layer. Furthermore, for smoothing the receiving layer surface, the sheet was subjected to a calendering treatment (roll surface temperature: 80° C., nip pressure: 2.5 MPa). In this way, a receiving sheet was obtained.

Example 15

A receiving sheet was obtained in the same manner as in Example 14 except that in the formation of the intermediate layer of Example 14, Intermediate Layer Coating Solution 14 having the following composition was coated to have a dry thickness of 52 μm and dried to form the intermediate layer.

| Intermediate Layer Coating Solution 14 | |
|---|---|
| Prefoamed hollow particles formed of a copolymer mainly comprising acrylonitrile and methacrylonitrile (average particle diameter: 8 μm, hollow percentage by volume: 76%, Tg of partition wall resin: 152° C.) | 45 parts |
| Polyvinyl alcohol (PVA205, trade name, produced by Kuraray Co., Ltd.) | 10 parts |

-continued

| Intermediate Layer Coating Solution 14 | |
|---|---|
| Styrene-butadiene latex (PT1004, trade name, produced by Nippon ZEON Corporation) | 45 parts |
| Water | 250 parts |

Example 16

A receiving sheet was obtained in the same manner as in Example 14 except that in the formation of the intermediate layer of Example 14, Intermediate Layer Coating Solution 15 having the following composition was coated to have a dry thickness of 45 μm and dried to form the intermediate layer.

| Intermediate Layer Coating Solution 15 | |
|---|---|
| Prefoamed hollow particles formed of a copolymer mainly comprising acrylonitrile and methacrylonitrile (average particle diameter: 3.4 μm, hollow percentage by volume: 65%, Tg of partition wall resin: 152° C.) | 55 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 35 parts |
| Water | 250 parts |

Example 17

A receiving sheet was obtained in the same manner as in Example 14 except that in the formation of the intermediate layer of Example 14, Intermediate Layer Coating Solution 16 having the following composition was coated to have a dry thickness of 65 μm and dried to form the intermediate layer.

| Intermediate Layer Coating Solution 16 | |
|---|---|
| Prefoamed hollow particles formed of a copolymer mainly comprising acrylonitrile and methacrylonitrile (average particle diameter: 3.3 μm, hollow percentage by volume: 85%, Tg of partition wall resin: 152° C.) | 40 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 50 parts |
| Water | 250 parts |

Example 18

A receiving sheet was obtained in the same manner as in Example 14 except that in the formation of the intermediate layer of Example 14, Intermediate Layer Coating Solution 17 having the following composition was coated to have a dry thickness of 51 μm and dried to form the intermediate layer.

| Intermediate Layer Coating Solution 17 | |
|---|---|
| Prefoamed hollow particles formed of a copolymer mainly comprising acrylonitrile and methacrylonitrile (average particle diameter: 3.5 μm, hollow percentage by volume: 78%, Tg of partition wall resin: 131° C.) | 45 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 45 parts |
| Water | 250 parts |

Example 19

A thermal transfer receiving sheet was obtained in the same manner as in Example 14 except that, in the formation of the intermediate layer of Example 14, Intermediate Layer Coating Solution 18 having the following composition was coated to have a dry thickness of 54 μm and dried to form the intermediate layer.

| Intermediate Layer Coating Solution 18 | |
|---|---|
| Prefoamed hollow particles formed of a copolymer mainly comprising acrylonitrile and methacrylonitrile (average particle diameter: 3.2 μm, hollow percentage by volume: 76%, Tg of partition wall resin: 152° C.) | 40 parts |
| Microcapsule-type hollow particles (ROHPAKE HP-1055, trade name, produced by Rohm & Haas, average particle diameter: 1.0 μm, hollow percentage by volume: 55%, Tg of partition wall resin: 100° C.) | 5 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 45 parts |
| Water | 250 parts |

Example 20

A thermal transfer receiving sheet was obtained in the same manner as in Example 14 except that in the formation of the intermediate layer of Example 14, Intermediate Layer Coating Solution 19 having the following composition was coated to have a dry thickness of 58 μm and dried to form the intermediate layer.

| Intermediate Layer Coating Solution 19 | |
|---|---|
| Prefoamed hollow particles formed of a copolymer mainly comprising acrylonitrile and methacrylonitrile (average particle diameter: 3.2 μm, hollow percentage by volume: 76%, Tg of partition wall resin: 152° C.) | 34 parts |
| Microcapsule-type hollow particles (ROHPAKE HP-1055, trade name, produced by Rohm & Haas, average particle diameter: 1.0 μm, hollow percentage by volume: 55%, Tg of partition wall resin: 100° C.) | 11 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 45 parts |
| Water | 250 parts |

Example 21

A thermal transfer receiving sheet was obtained in the same manner as in Example 14 except that in the formation of the intermediate layer of Example 14, Intermediate Layer Coating Solution 13 was coated to have a dry thickness of 29 μm and dried to form the intermediate layer.

Example 22

A thermal transfer receiving sheet was obtained in the same manner as in Example 14 except that in the formation of the intermediate layer of Example 14, Intermediate Layer Coating Solution 13 was coated to have a dry thickness of 72 μm and dried to form the intermediate layer.

Example 23

A receiving sheet was obtained in the same manner as in Example 14 except that in the formation of the intermediate layer of Example 14, Intermediate Layer Coating Solution 20 having the following composition was coated to have a dry thickness of 40 μm and dried to form the intermediate layer.

| Intermediate Layer Coating Solution 20 | |
|---|---|
| Prefoamed hollow particles formed of a copolymer mainly comprising acrylonitrile and methacrylonitrile (average particle diameter: 3.2 μm, hollow percentage by volume: 76%, Tg of partition wall resin: 152° C.) | 35 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 55 parts |
| Water | 250 parts |

Example 24

A receiving sheet was obtained in the same manner as in Example 14 except that in the formation of the intermediate layer of Example 14, Intermediate Layer Coating Solution 21 having the following composition was coated to have a dry thickness of 74 μm and dried to form the intermediate layer.

| Intermediate Layer Coating Solution 21 | |
|---|---|
| Prefoamed hollow particles formed of a copolymer mainly comprising acrylonitrile and methacrylonitrile (average particle diameter: 3.2 μm, hollow percentage by volume: 76%, Tg of partition wall resin: 152° C.) | 65 parts |
| Polyvinyl alcohol (PVA205, trade name, produced by Kuraray Co., Ltd.) | 10 parts |
| Styrene-butadiene latex (PT1004, trade name, produced by Nippon ZEON Corporation) | 25 parts |
| Water | 250 parts |

Furthermore, the uniformity of the recorded image in the gradation portion corresponding to an optical density (black) of 0.3 was evaluated by observing with an eye whether irregular shading and white spot were present or not. The evaluation results were rated Ex. when excellent, Good when good, Fair when irregular shading and white spot were observed, or Poor when defects of irregular shading and white spot were serious.

When the evaluation result is the Good level or higher, the receiving sheet is sufficiently suited for practical use.

The heat resistance of the receiving sheet was evaluated by observing with an eye whether the recorded image part near the maximum density of 2.1 was dented due to the thermal head. The evaluation results were rated Ex. when excellent, Good when good, Fair when the dent of the recorded image part was noticeable, or Poor when the dent was serious. When the evaluation result is at the Good level or higher, the receiving sheet is sufficiently suited for practical use.

TABLE 3

| | Prefoamed Hollow Particles A | | | | | Intermediate Layer | | | | | |
|---|---|---|---|---|---|---|---|---|---|---|---|
| | Average Particle Diameter (μm) | Hollow Percentage by Volume (%) | | Kind of Monomer (*1) | Ratio by Mass to All Hollow Particles (%) | Thickness (μm) | Ratio by Mass to All Hollow Particles (%) | Printing Smoothness Rp Value (μm) | Printing Density | Image Uniformity | Heat Resistance of Receiving Sheet (dent) |
| Example 14 | 3.2 | 76 | 2.15 | AN/MAN | 100 | 51 | 45 | 0.9 | 2.15 | Ex. | Ex. |
| Example 15 | 8 | 76 | 2.12 | AN/MAN | 100 | 52 | 45 | 1.3 | 2.12 | Good | Ex. |
| Example 16 | 3.4 | 65 | 2.07 | AN/MAN | 100 | 45 | 55 | 1.0 | 2.07 | Good | Ex. |
| Example 17 | 3.3 | 85 | 2.18 | AN/MAN | 100 | 65 | 40 | 0.9 | 2.18 | Ex. | Ex. |
| Example 18 | 3.5 | 78 | 2.16 | AN/MAN | 100 | 51 | 45 | 1.0 | 2.16 | Ex. | Good |
| Example 19 | 3.2 | 76 | 2.11 | AN/MAN | 88 | 54 | 45 | 0.9 | 2.11 | Ex. | Ex. |
| Example 20 | 3.2 | 76 | 2.05 | AN/MAN | 76 | 58 | 45 | 1.0 | 2.05 | Good | Good |
| Example 21 | 3.2 | 76 | 2.09 | AN/MAN | 100 | 29 | 45 | 1.2 | 2.09 | Good | Ex. |
| Example 22 | 3.2 | 76 | 2.18 | AN/MAN | 100 | 72 | 45 | 0.9 | 2.18 | Ex. | Ex. |
| Example 23 | 3.2 | 76 | 2.07 | AN/MAN | 100 | 40 | 35 | 1.1 | 2.07 | Good | Ex. |
| Example 24 | 3.2 | 76 | 0.17 | AN/MAN | 100 | 74 | 65 | 0.9 | 2.17 | Ex. | Ex. |

(*1) AN: Acrylonitrile, MAN: Methacrylonitrile

Evaluation

The receiving sheets obtained in Examples above each was evaluated by the following methods and the results obtained are shown in Table 3.

[Printing Quality (3)] (Printing Density, Image Uniformity, Heat Resistance)

Using a commercially available thermal transfer video printer (UP-DR100, trade name, manufactured by Sony Corp.), ink layers for three colors of an ink sheet comprising a 6 μm-thick polyester film having provided thereon ink layers each comprising a sublimable dye of yellow, magenta or cyan and a binder were sequentially contacted with the receiving sheet to be tested and then subjected to heating stepwise controlled by a thermal head to thermally transfer a predetermined image to the receiving sheet, whereby a half-tone monochromatic image of each color or a color mixed image was printed.

The reflection density of the recorded image transferred to the receiving sheet was measured by a Macbeth reflection densitometer (RD-914, trade name, manufactured by Kollmorgen) with respect to each applied energy. The reflection density in the high gradation part corresponding to the 15th step from the lower side of the applied energy is shown as the printing density in Table 3. When the printing density is 2.0 or more, the receiving sheet is sufficiently suited for practical use.

INDUSTRIAL APPLICABILITY

The receiving sheet of the present invention has an intermediate layer containing hollow particles and, by setting the printing smoothness to a certain value or less, is improved in irregular shading, lack of white spots and the like and suited as a receiving sheet for high-sensitivity recording with high image quality. Also, the printing processing method of the present invention can ensure improvement with respect to the generation of a scratch or a bruise on the printed surface and is applicable to the image formation by a dye thermal transfer printer. In a preferred embodiment, the receiving sheet of the present invention further has sufficiently high strength against compression and is free of denting. In a more preferred embodiment. the receiving sheet of the present invention also has a sufficiently high heat resistance.

The invention claimed is:

1. A thermal transfer receiving sheet comprising a sheet-like support having, sequentially formed on at least one surface thereof, a hollow particle-containing intermediate layer and an image receiving layer, wherein said hollow particles have an average particle diameter of 0.2 to 35 μm and a hollow percentage by volume of 30 to 97% and the printing smoothness (Rp value) on the surface of said thermal transfer receiving sheet, as measured by using a Microtopograph under an applied pressure of 0.1 MPa 10 milli-seconds after the initiation of pressure application, is 1.5 μm or less, wherein said intermediate layer comprises two kinds of hollow particles A and B differing in the average particle diameter and the average particle diameters $L_A$ (μm) and $L_B$ (μm) of respective hollow particles satisfy all of the following relational formulae (1) to (3):

$$L_A=2 \text{ to } 35\ \mu m \quad (1)$$

$$L_B=0.2 \text{ to } 9\ \mu m \quad (2)$$

$$0.05<L_B/L_A<0.4 \quad (3)$$

and wherein the ratio of the mass of hollow particles A ($W_A$) and that of hollow particles B ($W_B$) included in said intermediate layer satisfies the following relational formula (4):

$$W_B/W_A=0.001 \text{ to } 1 \quad (4).$$

2. The thermal transfer receiving sheet as claimed in claim 1, wherein the thickness of said intermediate layer is from 20 to 90 μm.

3. The thermal transfer receiving sheet as claimed in claim 1, wherein the ratio by mass of all hollow particles to the entire solid content mass of said intermediate layer is from 30 to 75% by mass.

4. The thermal transfer receiving sheet as claimed in claim 1, which has a barrier layer stacked between said intermediate layer and said image receiving layer.

5. The thermal transfer receiving sheet as claimed in claim 1, wherein said sheet-like support is a sheet-like support mainly comprising a cellulose pulp.

6. The thermal transfer receiving sheet as claimed in claim 1, wherein a back surface layer containing at least a polymer resin and an organic and/or inorganic fine particles is provided on the side of said sheet-like support in which the image receiving layer is not provided.

7. The thermal transfer receiving sheet as claimed in claim 1, wherein the compressive modulus of elasticity, based on JIS K 7220, of said thermal transfer receiving sheet is 30 MPa or less.

8. The thermal transfer receiving sheet as claimed in claim 1, wherein said intermediate layer comprises, as said hollow particles, hollow particles with the partition wall being formed of a polymer material having a glass transition temperature of 130° C. or more.

9. The thermal transfer receiving sheet as claimed in claim 8, wherein the polymer material of said hollow particles with the partition wall, being formed of a polymer material having a glass transition temperature of 130° C. or more, is obtained from a component mainly comprising a nitrile-based monomer.

10. The thermal transfer receiving sheet as claimed in claim 9, wherein said nitrile-based monomer is at least one member selected from the group consisting of acrylonitrile, methacrylonitrile, α-chloroacrylonitrile, α-ethoxyacrylonitrile and fumaronitrile.

11. An image forming method using the thermal transfer receiving sheet claimed in claim 1, comprising the steps of applying a pressure treatment of 1.0 MPa or more to the thermal transfer receiving sheet surface during and/or after printing by a dye thermal transfer printer.

12. A method for producing a thermal transfer receiving sheet comprising a sheet-like support having sequentially formed on at least one surface thereof a hollow particle-containing intermediate layer and an image receiving layer, the method comprising the steps of, after providing said intermediate layer by coating an intermediate layer coating solution comprising hollow particles having an average particle diameter of 0.2 to 35 μm and a hollow percentage by volume of 30 to 97% on at least one surface of said sheet-like support and drying it and/or after providing said image receiving layer on the intermediate layer, wherein said intermediate layer comprises two kinds of hollow particles A and B differing in the average particle diameter and the average particle diameters $L_A$ (μm) and $L_B$ (μm) of respective hollow particles satisfy all of the following relational formulae (1) to (3):

$$L_A=2 \text{ to } 35\ \mu m \quad (1)$$

$$L_B=0.2 \text{ to } 9\ \mu m \quad (2)$$

$$0.05<L_B/L_A<0.4 \quad (3),$$

applying a smoothing treatment step of passing the sheet through a nip part having a pair of rolls consisting of a heating roll and a press roll so that the printing smoothness (Rp value) on the surface of said thermal transfer receiving sheet, as measured by using Microtopograph under an applied pressure of 0.1 MPa 10 milli-seconds after the initiation of pressure application, can be 1.5 μm or less.

13. The method for producing a thermal transfer receiving sheet, as claimed in claim 12, which further comprises a thickness restoring treatment step of, after said smoothing treatment step, subsequently heating the thermal transfer receiving sheet by contacting the sheet surface with a heating roll in a pressure-released state.

* * * * *